US010337537B2

(12) United States Patent
Brinkman et al.

(10) Patent No.: US 10,337,537 B2
(45) Date of Patent: Jul. 2, 2019

(54) SYSTEM AND METHOD FOR DETERMINING A HEALTH STATUS OF A TANK

(71) Applicant: Caterpillar Inc., Peoria, IL (US)

(72) Inventors: Jason Brinkman, Peoria, IL (US); Richard Andrew Carpenter, Chillicothe, IL (US)

(73) Assignee: Caterpillar Inc., Deerfield, IL (US)

( * ) Notice: Subject to any disclaimer, the term of this patent is extended or adjusted under 35 U.S.C. 154(b) by 118 days.

(21) Appl. No.: 15/690,389

(22) Filed: Aug. 30, 2017

(65) Prior Publication Data

US 2019/0063474 A1 Feb. 28, 2019

(51) Int. Cl.

| | |
|---|---|
| ***G06G 5/00*** | (2006.01) |
| ***F15B 19/00*** | (2006.01) |
| *F15B 1/26* | (2006.01) |

(52) U.S. Cl.

CPC ..... *F15B 19/005* (2013.01); *G06G 5/00* (2013.01); *F15B 1/26* (2013.01)

(58) Field of Classification Search

CPC ..... F15B 1/26; F15B 2211/253

See application file for complete search history.

(56) References Cited

U.S. PATENT DOCUMENTS

| | | | | |
|---|---|---|---|---|
| 4,727,792 | A * | 3/1988 | Haussler | F15B 13/01 137/493.3 |
| 5,125,323 | A * | 6/1992 | Yonezawa | F15B 13/01 137/493.3 |
| 5,379,638 | A | 1/1995 | Denz et al. | |
| 5,398,661 | A | 3/1995 | Denz et al. | |
| 5,509,296 | A | 4/1996 | Kolb | |
| 7,418,856 | B2 | 9/2008 | Kohler | |
| 8,407,994 | B2 | 4/2013 | Kamoshida et al. | |
| 2004/0134189 | A1 * | 7/2004 | Brigden | F15B 1/26 60/368 |
| 2013/0284532 | A1 * | 10/2013 | McVey | B62D 5/30 180/403 |

* cited by examiner

*Primary Examiner* — John Fox

(74) *Attorney, Agent, or Firm* — William R. Tinker

(57) ABSTRACT

A system for determining a health status of a tank is provided. The system includes a temperature sensor, a pressure sensor, a sensor coupled to a hydraulic actuator, a breather valve, and a controller. The controller is configured to receive a signal indicative of a temperature and a volume of a fluid within the tank from the temperature sensor and the sensor coupled to the hydraulic actuator respectively. The controller is configured to determine an estimated pressure of the fluid within the tank based on the received signals and a breather performance curve. The controller is configured to receive a signal indicative of a pressure of the fluid within the tank and compare it with the estimated pressure. The controller is also configured to determine the health status of the tank and to actuate one or more of an operator console display unit and the hydraulic actuator.

20 Claims, 4 Drawing Sheets

SYSTEM AND METHOD FOR DETERMINING A HEALTH STATUS OF A TANK

TECHNICAL FIELD

The present disclosure relates to a system and a method for determining a health status of a tank. More particularly, the present disclosure relates to the system and the method for determining the health status of the tank associated with a machine.

BACKGROUND

Numerous types of hydraulic systems may be implemented and utilized on a variety of machines or mechanical systems. In particular, hydraulic systems may be functionally implemented in a variety of machines or mechanical systems to generate and/or direct a flow of hydraulic fluid to perform a variety of functions. One or more tanks, reservoirs, or other containers may be used to store, provide, and/or receive the hydraulic fluid prior to, during, and/or following the use of the hydraulic fluid by the hydraulic system.

While hydraulic fluid tanks and other similar reservoirs, containers, and the like may be commonly used in numerous hydraulic systems and may be effective as a source of the hydraulic fluid, common, previously known tanks, reservoirs and other similar containers which store the hydraulic fluid may be characterized by drawbacks or deficiencies. In particular, previously known hydraulic tanks or reservoirs may be susceptible to any one or more of adverse pressure conditions, introduction of foreign material, leakage, and/or other complications which may compromise a proper operation and/or condition of one or more other components of the hydraulic system.

U.S. Pat. No. 8,407,994 describes a rotation control system of a hoist pump. The system includes the hoist pump and an engine for driving the hoist pump. The system includes a working equipment driven by a hydraulic cylinder that is extendable by hydraulic oil delivered through the hoist pump. The system also includes a hydraulic oil tank that stores the hydraulic oil supplied to the hoist pump and receives the hydraulic oil returned from the hydraulic cylinder. The system further includes a controller that controls a rotation speed of the hoist pump to be an allowable rotation speed that is set in advance for preventing cavitation while the hydraulic cylinder is operated.

SUMMARY OF THE DISCLOSURE

In an aspect of the present disclosure, a system for determining a health status of a tank is provided. The system includes a hydraulic system including the tank and at least one hydraulic actuator. The hydraulic actuator is coupled in fluid communication with a fluid within the tank. The system includes one or more sensors coupled to the tank. The one or more sensors include a temperature sensor and a pressure sensor. The system includes at least one sensor coupled to the at least one hydraulic actuator. The at least one sensor is configured to sense an amount of the fluid within the at least one hydraulic actuator. The system also includes a breather valve coupled to the tank. The system further includes a controller controllably connected to the at least one hydraulic actuator and connected in electronic communication with an operator console display unit, the one or more sensors coupled to the tank, and the at least one sensor coupled to the at least one hydraulic actuator. The controller is configured to receive a signal indicative of a temperature of the fluid within the tank from the temperature sensor. The controller is configured to receive a signal indicative of a volume of the fluid within the tank from the at least one sensor coupled to the at least one hydraulic actuator. The controller is configured to determine an estimated pressure of the fluid within the tank based on the signal indicative of the temperature of the fluid within the tank received from the temperature sensor and the signal indicative of the volume of the fluid within the tank received from the at least one sensor coupled to the at least one hydraulic actuator and a breather performance curve associated with the breather valve. The controller is configured to receive a signal indicative of a pressure of the fluid within the tank from the pressure sensor. The controller is configured to compare the estimated pressure with the pressure of the fluid within the tank. The controller is also configured to determine the health status of the tank based on the comparison. The controller is further configured to actuate one or more of the operator console display unit and the at least one hydraulic actuator based upon the determined health status of the tank.

In another aspect of the present disclosure, a system for determining a health status of a tank is provided. The system includes a hydraulic system including the tank and at least one hydraulic actuator. The hydraulic actuator is coupled in fluid communication with a fluid within the tank. The system includes one or more sensors coupled to the tank. The one or more sensors include a fluid level sensor and a pressure sensor. The system also includes a breather valve coupled to the tank. The system further includes a controller connected in electronic communication with an operator console display unit and the one or more sensors coupled to the tank. The controller is configured to receive a signal indicative of a volume of the fluid within the tank from the fluid level sensor. The controller is configured to determine an estimated pressure of the fluid within the tank based on the signal indicative of the volume of the fluid within the tank received from the fluid level sensor and a breather performance curve associated with the breather valve. The controller is configured to receive a signal indicative of a pressure of the fluid within the tank from the pressure sensor. The controller is configured to compare the estimated pressure with the pressure of the fluid within the tank. The controller is also configured to determine the health status of the tank based, at least in part, on the comparison. The controller is further configured to actuate one or more of the operator console display unit and the at least one hydraulic actuator based upon the determined health status of the tank.

In yet another aspect of the present disclosure, a method for determining a health status of a tank is provided. The method includes receiving a signal indicative of a temperature of a fluid within the tank from a temperature sensor. The method includes receiving a signal indicative of a volume of the fluid within the tank from at least one sensor coupled to at least one hydraulic actuator. The method includes determine an estimated pressure of the fluid within the tank based on the signal indicative of a temperature of the fluid within the tank received from the temperature sensor and the signal indicative of the volume of the fluid within the tank received from the at least one sensor coupled to the at least one hydraulic actuator and a breather performance curve associated with a breather valve. The method includes receiving a signal indicative of a pressure of the fluid within the tank from a pressure sensor. The method includes comparing the estimated pressure with the pressure of the fluid within the tank. The method also includes determining the health status of the tank based on the comparison. The method further includes actuating one or more of an operator console display unit and the at least one hydraulic actuator based upon the determined health status of the tank.

Other features and aspects of this disclosure will be apparent from the following description and the accompanying drawings.

DETAILED DESCRIPTION

Figure 1:
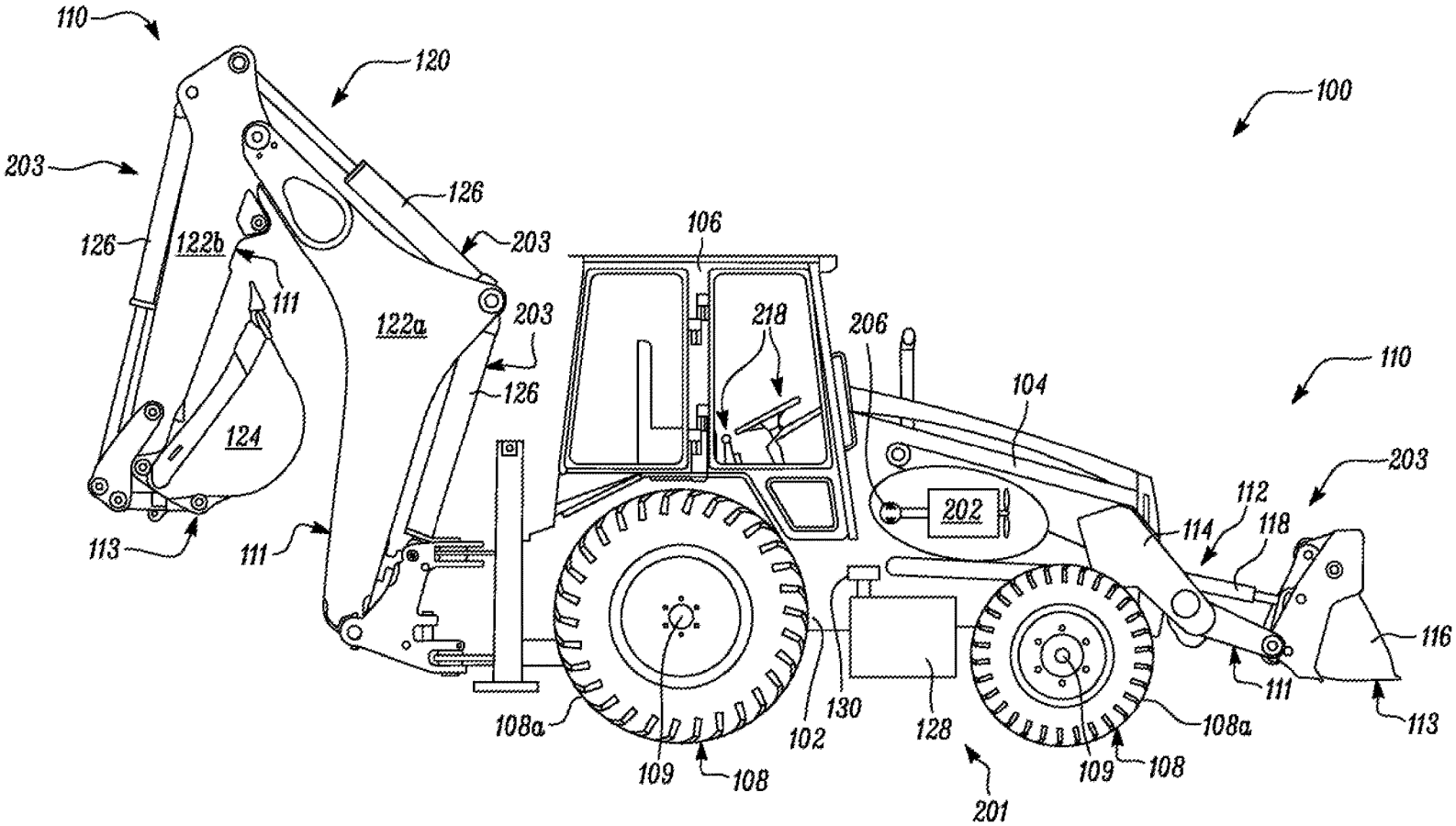
FIG. 1 is a side view of an exemplary machine, according to one embodiment of the present disclosure.

Wherever possible, the same reference numbers will be used throughout the drawings to refer to the same or the like parts. Referring to FIG. 1, an exemplary machine 100 is illustrated. More specifically, the machine 100 is illustrated as a backhoe loader in FIG. 1 for the purposes of providing one non-limiting example of the machine 100 into which a health determination system 200 according to any one or more of the embodiments of the present disclosure can be implemented and utilized. However, it should be understood that, for the purposes of the present disclosure, the machine 100 can be any machine or mechanical system which can utilize a hydraulic system 201, including, in part, at least one tank 128 and at least one hydraulic actuator 203, functionally implemented therein to generate and/or direct a flow of a hydraulic fluid to perform any one or more of a variety of functions associated with the machine 100, with which the health determination system 200 according to any one or more of the embodiments of the present disclosure can be implemented and utilized.

In other embodiments, the machine 100 may be any other machine, such as a wheel loader, a motor grader, a truck, a tractor, a dozer, an excavator, and so on. The machine 100 may be adapted to perform activities, such as excavation, demolishment, transportation, material handling, construction, and so on. In other embodiments, the machine 100 may be any machine related to an industry including, but not limited to, transportation, agriculture, construction, manufacturing, forestry, waste management, material handling, marine, aviation, and aerospace.

The machine 100 includes a frame 102. The frame 102 is adapted to support various components of the machine 100 thereon. The machine 100 includes an enclosure 104 mounted on the frame 102. The enclosure 104 is adapted to house a power source, illustrated as an internal combustion engine 202, therein mounted on the frame 102. Although the exemplary embodiment of FIG. 1 (as well as FIG. 2) illustrates the power source as the internal combustion engine 202, it is to be understood that the power source can be any power source capable of providing motive and/or actuational power to the machine 100 known in the art, such as an electrical motor, a fuel cell, a battery, a motor, and/or a combination thereof and so on.

The machine 100 includes an operator station 106 mounted on the frame 102. The operator station 106 includes an operator console display unit 204 (shown in FIG. 2) as well as one or more input devices 218 (shown in FIG. 2), which can be embodied as any one or more of, or any combination of a steering wheel, levers, pedals, joysticks, buttons, and the like, actuated by an operator to effectuate control and operation of the machine 100, as well as components thereof as disclosed herein. The machine 100 also includes two or more ground engaging propulsion devices or mechanisms 108 rotatably attached to and supporting the frame 102 which are driven, in part, by the engine 202 of the machine 100 to effectuate one or more of a movement, turning, positioning, and travel of the machine 100.

The two or more ground engaging propulsion devices or mechanisms 108 can be embodied as wheels **108*a* mounted to the frame 102 of the machine 100 via axles 109 for wheel-driven machines including the exemplary machine 100 illustrated in FIG. 1 as the backhoe loader. However, the scope of the present disclosure is not meant to be limited thereby, as the machine 100 can include any other type of suitable ground engaging propulsion devices or mechanisms 108**, such as two or more endless tracks for track driven machines.

The machine 100 includes at least one hydraulically actuated machine assembly which can be embodied as and/or include at least one hydraulically actuated machine linkage assembly 110, which includes at least one linkage body 111 pivotally or otherwise movably coupled to the frame 102 of the machine 100 and/or pivotally or otherwise movably coupled to one or more work tools 113 (which include, in the exemplary embodiment shown in FIG. 1, a blade 116 and a bucket 124) via one or more hydraulic actuators 203, including hydraulic cylinders 118, 126, as further disclosed herein. In the exemplary embodiment shown in FIG. 1, the at least one hydraulically actuated machine linkage assembly 110 includes a first linkage assembly 112, wherein the at least one linkage body 111 of the first linkage assembly 112 includes and/or is embodied as a linkage arm 114 pivotally or otherwise movably coupled to a front of the frame 102.

The first linkage assembly 112 also includes a blade 116 pivotally or otherwise movably coupled to the linkage arm 114. In other embodiments, the first linkage assembly 112 may include any other work tool 113 or other similar implement, such as a bucket, an auger, a hammer, a drill bit, a ripper, a pulverizer, a fork, a grappel, and so on, based on application requirements. The first linkage assembly 112 also includes one or more hydraulic cylinders 118 attached to and extending between the frame 102 and the linkage arm 114 and/or the linkage arm 114 and the blade 116, wherein each of the one or more hydraulic cylinders 118 are actuated, in part, by the hydraulic system 201 (and the components thereof, as discussed herein) to extend and retract to effectuate relative movement between the linkage arm 114 and/or the blade 116 and the frame 102, as well as to effectuate relative movement between the linkage arm 114 and the blade 116.

In the exemplary embodiment shown in FIG. 1, the at least one hydraulically actuated machine linkage assembly 110 of the machine 100 further includes a second linkage assembly 120, wherein the at least one linkage body 111 of the second linkage assembly 120 includes and/or is embodied as including a first linkage arm **122*a* and a second linkage arm 122*b*, wherein the first linkage arm 122*a* is pivotally or otherwise movably coupled to a rear of the frame 102, and the second linkage arm 122***b* is pivotally or otherwise movably coupled (at opposing ends thereof) to and between the first linkage arm 122*a* and the bucket 124.

In other embodiments, the work tool 113 of the second linkage assembly 120 may include any other implement, such as a blade, an auger, a hammer, a drill bit, a ripper, a pulverizer, a fork, a grappel, and so on, based on application requirements. The second linkage assembly 120 also includes one or more hydraulic cylinders 126 attached to and extending between the frame 102 and the first linkage arm 122*a*, the first linkage arm 122*a* and the second linkage arm 122*b*, and the second linkage arm 122*b* and the bucket 124, wherein each of the one or more hydraulic cylinders 126 are actuated, in part, by the hydraulic system 201 (and the components thereof, as discussed herein) to extend and retract to effectuate relative movement between the frame 102 of the machine 100, the first and second linkage arms 122*a*, 122*b*, and the bucket 124.

The first linkage assembly 112 and the second linkage assembly 120 as well as the hydraulic actuators 203 embodied as the hydraulic cylinders 118, 126 illustrated in FIG. 1 are meant to serve as illustrative examples of hydraulically actuated machine assemblies which can be included in and actuated by the hydraulic system 201 of the machine 100. As such, it is to be understood that additional or alternative hydraulically actuated machine assemblies and/or hydraulic components can be included in the machine 100 and included within the scope of the present disclosure as being monitored by any one or more of the embodiments of the health determination system 200 as disclosed herein.

Figure 2:
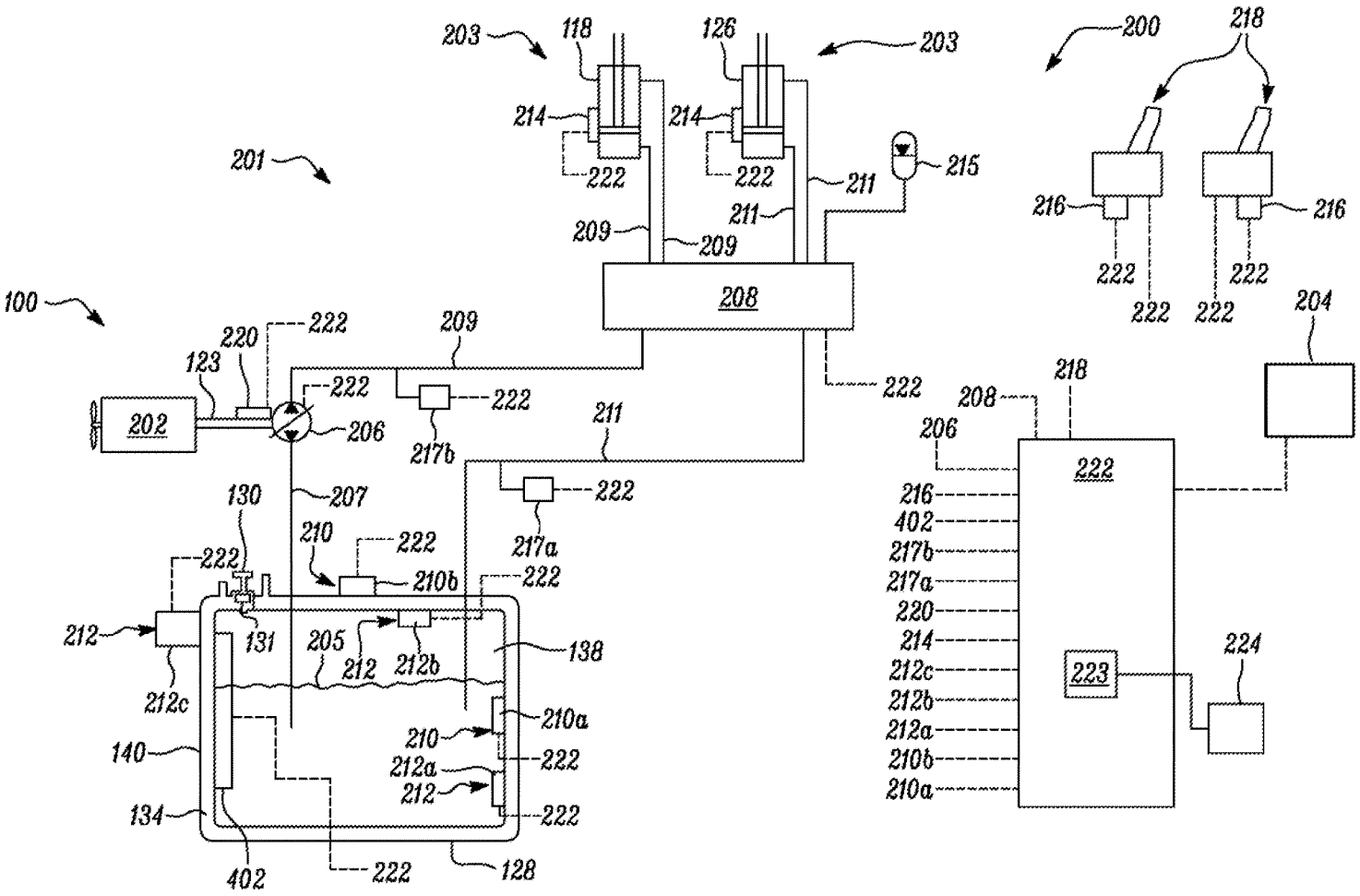
FIG. 2 is a schematic representation of a health determination system for a tank associated with the machine of FIG. 1, according to one embodiment of the present disclosure.
Figure 4:
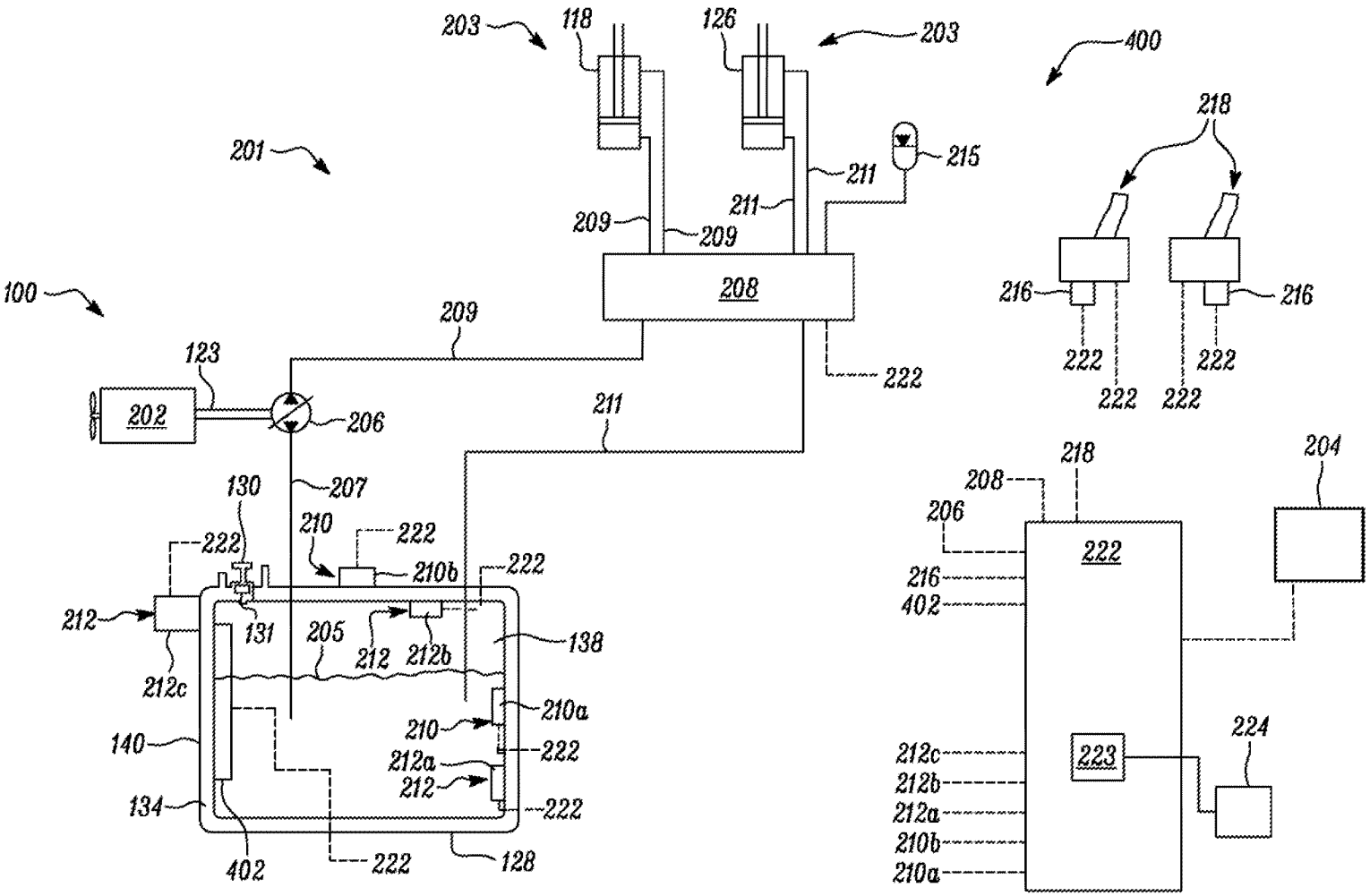
FIG. 4 is a schematic representation of a health determination system for the tank associated with the machine of FIG. 1, according to another embodiment of the present disclosure.

As shown in FIG. 1, and as further illustrated in FIG. 2 and FIG. 4, the machine 100 also includes the hydraulic system 201 which includes, in part, the at least one tank 128 which can be mounted on the frame 102. The tank 128 is a tank, reservoir, container, or other vessel which stores, supplies, and/or receives a hydraulic fluid 205 (as shown in FIG. 2 and FIG. 4) such as hydraulic oil, prior to, during, and/or following the use of the hydraulic fluid 205 by the hydraulic system 201 of the machine 100. The hydraulic system 201 is functionally implemented into the machine 100 to generate and/or direct a flow of the hydraulic fluid (such as the hydraulic fluid 205) to perform any one or more of a variety of functions associated with the machine 100.

In the exemplary embodiment illustrated in FIG. 1 (and further illustrated in the exemplary embodiments of FIG. 2 and FIG. 4), the hydraulic system 201 of the machine 100 includes the at least one tank 128, the one or more hydraulic actuators 203 including and/or embodied as the one or more hydraulic cylinders 118, 126 and a pump 206, and one or more valves 208. The hydraulic system 201 can also include additional hydraulic components fluidly connected and integrated therein, such as at least one accumulator 215. As further disclosed herein, the tank 128 is fluidly connected to supply and receive (via the pump 206 and the one or more valves 208, as well as the additional components thereof as disclosed herein and illustrated in the exemplary embodiments of FIG. 2 and FIG. 4) the hydraulic fluid 205 to (and from) the hydraulic actuators 203 and any other components of the hydraulic system 201, including, in part, one or more of the one or more hydraulic cylinders 118, 126 and/or the accumulator 215.

The tank 128 also includes a breather valve assembly 130 fluidly coupled thereto. In particular, and as further illustrated in FIG. 2 (as well as FIG. 4), the breather valve assembly 130 can be integrated with and/or combined with a filter 131, or otherwise include the filter 131 therein. The breather valve assembly 130 and the associated filter 131 can be mounted on, or alternatively, within, an outer wall 134 of the tank 128, between a hollow interior 138 and an outer surface 140 of the tank 128, and the outer wall 134 thereof such that the breather valve assembly 130 may be configured to control, at least in part, a flow of air into and out of the tank 128. The breather valve assembly 130 is adapted to provide a selective barrier between ambient air of, and/or surrounding the outer surface 140 of the outer wall 134 of the tank 128 and air present within the hollow interior 138 of the tank 128.

More specifically, the breather valve assembly 130 can be actuated to control, limit, and/or restrict the flow of air therethrough to control, or limit the flow of air, from, or surrounding, the outer surface 140 of the outer wall 134 of the tank 128 into and out of the tank 128, and the hollow interior 138 thereof, based on a pressure relief setting thereof. Accordingly, the breather valve assembly 130 limits over pressurizing of the tank 128 based on a change of a fluid level therein, in turn, based on an operation of the one or more hydraulic cylinders 118, 126. The breather valve assembly 130 also limits a vacuum pressure within the tank 128 based on the change of the fluid level therein. Additionally, the breather valve assembly 130, including, in part, the filter 131 thereof, limits infiltration of contamination into the tank 128 during the flow of air into the tank 128.

FIG. 2 illustrates a schematic depiction of the health determination system 200 according to an embodiment of the present disclosure. In particular, FIG. 2 provides a schematic depiction of the machine 100, and the hydraulic system 201 thereof, as one example of the hydraulic system 201 (and the tank 128 thereof) with which the health determination system 200 can be implemented and utilized. As such, it should be understood that, the hydraulic system 201 (and the machine 100) illustrated in FIG. 2 (as well as in FIG. 1) can include any one or more additional, fewer, and/or alternative components, connections, and configurations to which the tank 128 can be connected and for which the health determination system 200 of the present disclosure can be utilized without departing from the spirit and scope of the present disclosure.

The hydraulic system 201 of the machine 100 includes the pump 206. The pump 206 can be operatively and mechanically coupled to the engine 202 of the machine 100 such that the pump 206 is driven by the engine 202. In one embodiment, the pump 206 is driven by a pump input shaft 123 which can be rotationally coupled to and driven by the engine 202, alternatively, the pump 206 may be rotationally coupled to and/or driven by the engine 202 via any one or more of, or any combination of any one of more of a belt, a transmission (including, for example, gears and/or clutches), or any other suitable component(s) and/or configuration(s).

The pump 206 can be any component which functionally interacts with the hydraulic fluid 205 to convert mechanical energy to hydraulic energy, and/or vice versa. As such, the term "pump" as used in connection with the pump 206 is meant to include and be defined as any one or more of a hydraulic pump, a hydraulic motor, as well as a combination hydraulic pump/motor, as illustrated in FIG. 2. The pump 206 can be embodied as a piston pump (fixed displacement, variable displacement, over center), gear pump, vane pump, gerotor pump, etc. In addition, the pump 206 can be electronically and controllably connected to a controller 222, such that the operation and actuation of the pump 206 (as further disclosed herein) can be controlled in response to one or more signals generated by the controller 222 and electronically transmitted to, and received by, the pump 206.

The pump 206 is fluidly coupled to the tank 128 via a first conduit 207 which extends between and connects the pump 206 in fluid communication with the tank 128, and the hydraulic fluid 205 thereof. As such, when pump 206 is actuated as a pump, the forces generated via the operation of the pump 206 act to draw the hydraulic fluid 205 housed within the tank 128 into and through the first conduit 207 and into the pump 206 such that the pump 206 can supply the flow of hydraulic fluid 205, and in one or more embodiments, a flow of pressurized hydraulic fluid 205 to the one or more components of the hydraulic system 201, wherein a rotational speed of the pump 206 may define or control a flow rate of the hydraulic fluid 205 delivered or output by the pump 206, and a displacement of the pump 206 may define or control a pressure of the hydraulic fluid 205 delivered or output by the pump 206. When pump 206 is actuated as a pump, the first conduit 207 may be defined, in one example, as a pump inlet conduit.

As additionally shown in the exemplary embodiment of FIG. 2, the pump 206 can be fluidly connected to deliver (and/or in some embodiments, receive) the flow of the hydraulic fluid 205 to the hydraulic actuators 203, embodied as the hydraulic cylinders 118, 126 of the hydraulic system 201, which can be via the one or more valves 208. In particular, the hydraulic system 201 can include at least one second conduit 209 which extends between and connects the pump 206 in fluid communication with the hydraulic cylinders 118, 126, as well as at least one third conduit 211 which extends between and connects the hydraulic cylinders 118, 126 in fluid communication with the tank 128.

When the pump 206 is actuated as a pump, the at least one second conduit 209 can be connected to fluidly communicate and direct the hydraulic fluid 205 delivered or output by the pump 206 into one or more of the hydraulic cylinders 118, 126 to actuate one or more of the hydraulic cylinders 118, 126 in a direction or manner consistent with an operator's actuation of the one or more input devices 218, and the at least one third conduit 211 can be connected to fluidly communicate the hydraulic fluid 205 directed out of the one or more hydraulic cylinders 118, 126 to the tank 128. Specifically, in the exemplary embodiment shown in FIG. 2, the one or more valves 208 may be connected in fluid communication with, and fluidly disposed within the second conduit 207 and the at least one third conduit 211 between the pump 206, the tank 128, and the hydraulic cylinders 118, 126.

With this exemplary configuration, the one or more valves 208 may be actuated to fluidly and controllably direct the flow of actuating hydraulic fluid 205 supplied by the pump 206 and fluidly communicated through the at least one second conduit 209 into the one or more hydraulic cylinders 118, 126 to actuate the one or more hydraulic cylinders 118, 126, and further may fluidly and controllably direct a return or drain flow of the hydraulic fluid 205 discharged or directed out of the one or more hydraulic cylinders 118, 126 into and through the at least one third conduit 211 and fluidly communicated or drained to the tank 128 thereby in a manner consistent with and as commanded by the operator's actuation of the one or more input devices 218. As such, in one embodiment, the one or more valves 208 may be connected in electronically controllable communication with the controller 222 to be actuated in response to and consistent with command signals generated by and received from the controller 222, as further disclosed herein.

Additionally, the hydraulic system 201 can include the at least one accumulator 215 fluidly connected to selectively receive and store, and discharge the pressurized hydraulic fluid 205 between the pump 206 and the tank 128. In particular, in the exemplary embodiment shown in FIG. 2, the at least one accumulator 215 is fluidly connected to receive and store the pressurized hydraulic fluid 205 therein from one or more of the pump 206 and the one or more hydraulic cylinders 118, 126 (and/or one or more combinations thereof), and discharge the pressurized hydraulic fluid 205 stored therein to the one or more hydraulic cylinders 118, 126 and/or the tank 128 (or any other hydraulic actuator 203) via the one or more valves 208.

As provided above, FIG. 2 further provides a schematic depiction of the health determination system 200 according to an embodiment of the present disclosure included and functionally implemented with the tank 128 as well as additional components of the hydraulic system 201 and the machine 100. The health determination system 200 will be hereinafter interchangeably referred to as the "system 200". The system 200 and the machine 100 include the controller 222. The controller 222 can be embodied as a machine control unit, a master electronic control unit, or a master controller of the machine 100 and can include one or more electronic control units as well as one or more electronic control modules which can include, in part, one or more processors, memory, one or more secondary storage devices, power supply circuitry, signal-conditioning circuitry, solenoid driver circuitry, and other appropriate circuitry, programming and/or control logic.

The controller 222 is illustrated and discussed herein as a single controller or a control unit as shown in FIG. 2 for the purposes of providing a clear, illustrative, exemplary disclosure without introducing undue complexity; notwithstanding, and as such, it should be understood that the controller 222 can be embodied as and include multiple controllers and/or control modules, such as, for instance, one or more master controllers/control modules and one or more local controllers/control modules, connected in electronic communication and configured to exchange, receive, transmit, monitor, generate, and/or process a plurality of sensed signals, information, and/or commands to monitor, regulate, and/or effectuate control and operation of the machine 100 as well as the system 200, the hydraulic system 201 thereof, as provided above and further discussed herein.

Referring to FIG. 2, the controller 222 is electronically connected (via wired or wireless electronic connections, shown via dashed lines in FIG. 2) to the components of the system 200 (as well as components of the hydraulic system 201 and additional machine 100 according to any one or more of the embodiments disclosed herein) and is configured, in part, to monitor, receive, and process one or more signals, inputs, commands, and any other data according to the embodiments as discussed herein to monitor, analyze, predict, and determine a health status of the tank 128.

The system 200, including, in part, the controller 222 thereof, can monitor and/or receive one or more actual, sensed tank pressure signals of the pressure within the tank 128, and additionally can analyze, process, or otherwise utilize one or more, or a plurality of inputs, sensed signals, stored data, graphical data, and/or commands (as well as combinations thereof) according to any of the embodiments as disclosed herein to calculate, process, and/or otherwise determine an expected tank pressure of the tank 128, wherein the expected tank pressure can be representative of, illustrative of, consistent with, and/or equivalent to a pressure maintained and present within a healthy, properly functioning, undamaged tank 128 having healthy, properly functioning, undamaged components (including, in part, the breather valve assembly 130 thereof) based upon the specific conditions under which the tank 128 is operating and subject to. In response, the system 200, including, in part, the controller 222 thereof, can compare the actual, sensed tank pressure signals of the pressure within the tank 128 to the expected tank pressure of the tank 128 determined by the controller 222, and based upon the comparison, determine (as well as monitor, analyze, and/or predict) the health status of the tank 128 according to any of the embodiments as further discussed herein.

As such, the system 200 includes a plurality of sensors which sense or otherwise detect a condition, state, or other aspect of the tank 128 (or a component thereof), a condition, operation, position, state, or other aspect of one or more other components of the hydraulic system 201 and/or the machine 100, and are connected to electronically communicate a signal indicative of the sensed or detected condition, operation, position, state, or other aspect of the associated component to the controller 222 to be used thereby (as well as any one or more of the additional inputs, commands, and any other data according to the embodiments as discussed herein) to monitor, analyze, predict, and determine the health status of the tank 128.

As shown in FIG. 2, the system 200 includes one or more pressure sensors 210 which are each connected to electronically communicate one or more signals indicative of a sensed pressure to the controller 222. The one or more pressure sensors 210 include a first pressure sensor 210*a* coupled to the tank 128. The first pressure sensor 210*a*, in one embodiment, is at least partially disposed within or exposed to the hollow interior 138 of the tank 128, or otherwise positioned and configured to sensingly engage and detect or sense a pressure "P" (as well as "$P_{tank, initial}$") of the hydraulic fluid 205 within the hollow interior 138 of the tank 128. In response, the first pressure sensor 210*a* generates and electronically communicates a signal indicative of the detected or sensed pressure "P"/"$P_{tank, initial}$" of the hydraulic fluid 205 within the tank 128 to the controller 222. The first pressure sensor 210*a* can additionally generate and electronically communicate a signal indicative of the detected or sensed pressure initial "$P_{tank, initial}$" of the hydraulic fluid 205 within the tank 128 to the controller 222.

A pressure of outer or ambient air "$P_a$" can be analyzed, processed, or otherwise utilized by the controller 222 to monitor, analyze, predict, and determine the health status of the tank 128 according to any one or more of embodiments of the present disclosure as discussed herein. In one example, the one or more pressure sensors 210 can also include a second pressure sensor 210*b* which is connected in electronic communication with the controller 222 and mounted to the outer wall 134 of the tank 128 and/or mounted at a position on the machine 100 (such as the frame 102 thereof) such that the second pressure sensor 210*b* is exposed to sensingly engage and detect, and electronically communicate, a sensed pressure of the outer or ambient air "$P_a$" surrounding the outer wall 134 of the tank 128 and/or the machine 100 to the controller 222.

Alternatively, the controller 222 can be configured, via internal processing control logic or the like, to derive or determine the pressure of the outer or ambient air "$P_a$" surrounding the outer wall 134 of the tank 128 and/or the machine 100, from, with reference to, based upon, and/or as an element of a signal received from another pressure sensor, for example, the detected or sensed pressure "P" and/or "$P_{tank, initial}$" sensed by and received from the first pressure sensor 210*a*, either alone, or in combination with one or more signals received from one or more other sensors as discussed herein, and/or data saved within a memory 223 of the controller 222 including, in part, a breather performance curve 224, as would be understood and realized by one of ordinary skill in the art upon receiving the benefit and knowledge of the teaching of the present disclosure, and as such, in one embodiment, the second pressure sensor 210*b* may be omitted.

Furthermore, the pressure "P" and/or "$P_{tank, initial}$" of the hydraulic fluid 205 detected or sensed by the first pressure sensor 210*a* may also include or be indicative of a pressure of the air within the hollow interior 138 of the tank 128. Each of the one or more pressure sensors 210, 210*a*, 210*b*, may be any suitable pressure sensor including, but not limited to, a strain gauge type pressure sensor, a capacitive type pressure sensor, an electromagnetic type pressure sensor, a piezoelectric type pressure sensor, and an optical type pressure sensor.

The system 200 also includes one or more temperature sensors 212, at least one of which is coupled to the tank 128 to sense and generate one or more signals indicative of a temperature of the fluids within the tank 128. In one embodiment, the one or more temperature sensors 212 include a first temperature sensor 212*a*, which, in one example, can be at least partially disposed within or otherwise exposed to the hollow interior 138 of the tank 128 (as well as the hydraulic fluid 205 therein), or otherwise positioned and configured to sensingly engage and detect or sense a temperature of the hydraulic fluid 205 within the hollow interior 138 of the tank 128.

The one or more temperature sensors 212 can also include a second temperature sensor 212*b*, which, in one example, can be at least partially disposed within or otherwise exposed to the hollow interior 138 of the tank 128 at a location to sensingly engage and detect or sense a temperature of the air "$T_{air}$" within the hollow interior 138 of the tank 128. The one or more temperature sensors 212 can also include a third temperature sensor 212*c* which can be mounted to the outer wall 134 of the tank 128 or mounted at a position on the machine 100 (such as the frame 102 thereof) such that the third temperature sensor 212*c* is exposed to sensingly engage and detect a sensed temperature of the outer or ambient air "$T_a$" surrounding the outer wall 134 of the tank 128 and/or the machine 100.

In response, each of the one or more temperature sensors 212, 212*a*, 212*b*, 212*c*, generates and electronically communicates a signal indicative of the detected or sensed temperature of the hydraulic fluid 205 within the tank 128, the detected or sensed temperature of the air "$T_{air}$" within the hollow interior 138 of the tank 128, and the detected or sensed temperature of the outer or ambient air "$T_a$" surrounding the outer wall 134 of the tank 128 and/or the machine 100, respectively, to the controller 222. Each of one or more temperature sensors 212, 212*a*, 212*b*, 212*c* may be any suitable temperature sensor including, but not limited to, a thermistor, a thermocouple, a resistance type temperature sensor, and an optical type temperature sensor.

Alternatively, the controller 222 can be configured, via internal processing control logic or the like, to derive or determine one or more of the temperature of the air "$T_{air}$" within the hollow interior 138 of the tank 128 and/or the temperature of the outer or ambient air "$T_a$", from, with reference to, based upon, and/or as an element of a signal received from the detected or sensed temperature of the hydraulic fluid 205 within the hollow interior 138 of the tank 128 sensed by and received from the first temperature sensor 212*a*, either alone, or in combination with one or more signals received from one or more other sensors as discussed herein, and/or data saved within the memory 223 of the controller 222 including, in part, the breather performance curve 224, as would be understood and realized by one of ordinary skill in the art upon receiving the benefit and teaching of the present disclosure, and as such, one or more of the second temperature sensor 212*b* and/or the third temperature sensor 212*c* may be omitted.

The controller 222 can monitor, receive, analyze, process, reference, and/or otherwise utilize, in part, one or more signals, inputs, commands, and any other data (or combinations thereof) indicative of the condition, operation, position, state, or other aspect of one or more other components of the hydraulic system 201 and/or the machine 100 as discussed above and further disclosed herein to determine one or more of a volume, flow, and/or amount of the hydraulic fluid 205 fluidly communicated and directed out of the tank 128 and flowing through, utilized by, and/or retained within the components of the hydraulic system 201 external to the tank 128 as disclosed herein.

In addition to being processed and utilized by the controller 222 as a direct measurement of the volume of the hydraulic fluid 205 contained within the tank 128, such signals, inputs, commands, and/or data indicative of the volume, flow, and/or amount of the hydraulic fluid 205 flowing through, utilized by, and/or retained within the components of the hydraulic system 201 external to the tank 128 can be received, analyzed, and processed by the controller 222 to determine, in part, a volume of the air "$V_{air}$" within the hollow interior 138 of the tank 128. Additionally, the volume, flow, and/or amount of the hydraulic fluid 205 flowing through, utilized by, and/or retained within the components of the hydraulic system 201 external to the tank 128 can be analyzed and processed by the controller 222 to derive, determine, validate, confirm, and/or modify one or more of the other tank pressure, temperature, volume, and/or mass values or calculations thereof, either alone or in combination with one or more additional data, inputs, commands, and/or sensed signals, as disclosed herein.

In one embodiment, one or more signals indicative of a degree of actuation of the hydraulic actuators 203 can be received and processed by the controller 222 to determine the amount of the hydraulic fluid 205 actuated thereby and/or contained therein. The amount of the hydraulic fluid 205 fluidly directed to and/or contained within the hydraulic actuators 203 can be analyzed, processed, and/or otherwise used by the controller 222 to determine the volume, flow, and/or amount of the hydraulic fluid 205 fluidly communicated and directed out of the tank 128 and flowing through, utilized by, and/or retained within the components of the hydraulic system 201 external to the tank 128. In the exemplary embodiment shown in FIG. 2, one or more signals indicative of a degree of actuation of the hydraulic actuators 203 can be received and processed by the controller 222 to determine the amount of the hydraulic fluid 205 actuated thereby and/or contained therein.

In the exemplary embodiment shown in FIG. 2, the system 200 includes a cylinder position sensor 214 coupled to each of the one or more hydraulic cylinders 118, 126 of the machine 100, which, in the exemplary embodiment of the machine 100 depicted as the backhoe loader, are associated with the first linkage assembly 112 and/or the second linkage assembly 120 respectively. The cylinder position sensors 214 can be coupled to, or otherwise associated with (as disclosed herein), the one or more hydraulic cylinders 118, 126 to sensingly engage and detect or sense a position, which can be a degree or length of extension or retraction, of the respective hydraulic cylinder 118, 126, and in response, each cylinder position sensor 214 generates and electronically communicates a signal indicative of the sensed or detected position of the respective hydraulic cylinder 118, 126 to the controller 222.

The cylinder position sensor 214 may be any suitable cylinder position detection sensor. For example, in one embodiment, each cylinder position sensor 214 can be attached to one of the hydraulic cylinders 118, 126 (or a component thereof) and can be embodied as a transducive type sensor, an ultrasonic sensor, an optical type sensor, a position sensor, or any other suitable sensor configured to detect or sense a position, which can be a degree or length of extension or retraction, of the respective, associated, hydraulic cylinder 118, 126. Alternatively, the cylinder position sensors 214 can be sensingly associated with the hydraulic cylinders 118, 126 (or the associated housings, ends, or components thereof) and configured to generate one or more signals indicative of an angle or orientation between the linkage body 111 and the frame 102, connected, adjacent linkage bodies 111, or the linkage body 111 and the work tool 113, to which each associated hydraulic cylinder 118, 126 is attached such that the controller 222 may calculate or otherwise determine a degree or length of extension or retraction, of each hydraulic cylinder 118, 126 based upon the angle or orientation signals in order to measure the position of the respective hydraulic cylinder 118, 126. As such, in the latter embodiment, each of the cylinder position sensors 214 can be an angle sensor or any other suitable sensor, such as a proximity sensor, an accelerometer, a magnetometer, a gyroscopic sensor, or an optical type sensor.

Additionally, the controller 222 can monitor, receive, analyze, process, reference, and/or otherwise utilize signals indicative of the speed of the pump 206 to determine one or more of a volume, flow, and/or amount of the hydraulic fluid 205 flowing through, utilized by, and/or retained within the components of the hydraulic system 201 external to the tank 128. In particular, the system 200 can include a pump speed sensor 220 attached to a rotational component of the pump 206, such as the input shaft 123 of the pump 206 which can be rotationally coupled to and driven by the engine 202 of the machine 100, to detect or sense the speed of the pump 206. The pump speed sensor 220 can additionally be connected in electronic communication with the controller 222 to generate and electronically communicate a signal indicative of the detected or sensed speed of the pump 206 to the controller 222. The pump speed sensor 220 may be any suitable sensor, such as a variable reluctance type speed sensor, a Hall Effect type speed sensor, an Eddy Current type speed sensor, a radar doppler type speed sensor, an accelerometer type speed sensor, and the like.

Additionally, the controller 222 can also be connected in electronic communication to receive, analyze, and/or process signals from one or more hydraulic fluid sensors 217*a*, 217*b*, to determine one or more of a volume, flow, and/or amount of the hydraulic fluid 205 flowing through, utilized by, and/or retained within the components of the hydraulic system 201 external to the tank 128. In particular, the system 200 and the hydraulic system 201 can include a first hydraulic fluid sensor 217*a* positioned in fluidly sensing engagement or proximity to sense and generate a signal indicative of the pressure and rate of flow of the hydraulic fluid 205 being returned and fluidly directed into the tank 128.

In one embodiment, the first hydraulic fluid sensor 217*a* can be positioned downstream of the hydraulic actuators 203 (such as the hydraulic cylinders 118, 126) as well as the at least one accumulator 215 of the hydraulic system 201 and upstream of the tank 128 to sense and generate a signal indicative of the pressure and rate of flow of the hydraulic fluid 205 being returned and fluidly directed into the tank 128 through the third conduit 211. The system 200 and the hydraulic system 201 can also include a second hydraulic fluid sensor 217*b* fluidly positioned to sense and generate a signal indicative of the pressure and rate of flow of the hydraulic fluid 205 being directed out of the tank 128, wherein in one embodiment, the second hydraulic fluid sensor 217*b* can be positioned to fluidly engage and sense the pressure and rate of flow of the hydraulic fluid 203 directed through the first conduit 207 downstream of the pump 206 and upstream of the hydraulic actuators 203 (such as the hydraulic cylinders 118, 126) as well as the at least one accumulator 215.

The controller 222 can receive and compare the one or more signals indicative of the pressure and rate of flow of the hydraulic fluid 205 being returned and fluidly directed into the tank 128 as well as the one or more signals indicative of the pressure and rate of flow of the hydraulic fluid 205 being directed out of the tank 128 electronically transmitted thereto via the first and second hydraulic fluid sensors 217*a*, 217*b*, respectively, and, based upon the comparison, can dynamically determine a volume of the hydraulic fluid 205 external to and/or retained within the tank 128.

Additionally, or in an alternative embodiment, the system 200 can also include a fluid level sensor 402 at least partially disposed within or otherwise exposed to the hollow interior 138 of the tank 128 (as well as the hydraulic fluid 205 therein) to sensingly engage the hydraulic fluid 205 and the amount or level (for example, height) at which the hydraulic fluid 205 fills the hollow interior 138 of the tank 128. In response, the fluid level sensor 402 generates and electronically communicates a signal indicative of the detected or sensed amount or fill level of the hydraulic fluid 205 within the tank 128 to the controller 222. The fluid level sensor 402 can be any suitable, but not limited to, a float type level sensor, a pressure type level sensor, a conductive type level sensor, an ultrasonic type level sensor, a capacitance type level sensor, an optical type level sensor, a microwave type level sensor, a magneto strictive type level sensor, and a magneto resistive type level sensor.

Sensed signals and/or command signals generated by and in response to the operator's actuation of one or more of the one or more input devices 218 (shown in FIG. 2 and additionally shown in FIG. 1) can be received and processed by the controller 222 to effectuate control and operation of the machine 100. Such signals and/or commands can also be processed by the controller 222 to determine an actuated position, orientation, and/or state of one or more other components of the hydraulic system 201 and/or the machine 100 to determine the volume, flow, and/or amount of the hydraulic fluid 205 fluidly communicated and directed out of the tank 128 and flowing through, utilized by, and/or retained within the components of the hydraulic system 201 external to the tank 128.

As discussed above and further disclosed herein, the one or more input devices 218 can be embodied as any one or more of, or any combination of a steering wheel, levers, pedals, joysticks, buttons, and the like, actuated by the operator to effectuate control and operation of the machine 100. The one or more input devices 218 can be connected in electronic communication with the controller 222 such that upon the operator's movement, positioning, or other actuation of the one or more input devices 218 corresponding to a desired control, operation, and/or movement of the machine 100 and/or the components thereof as disclosed herein, the actuated one or more input devices 218 can responsively generate and electronically transmit one or more operator command signals indicative and/or representative of the operator's desired control to the controller 222. In one embodiment, the system 200 includes and/or is electronically connected to one or more operator command sensors 216 coupled to one of each of the one or more input devices 218 of the machine 100, wherein each of the one or more operator command sensors 216 can sense, generate, and electronically transmit command signals indicative of the operator's actuation of the associated input device 218 to the controller 222 indicative and/or representative of the operator's desired control, operation, and/or movement of the machine 100.

The controller 222 can process the one or more operator command signals received from the actuated one or more input devices 218 (and, in one embodiment, the operator command sensors 216 connected thereto), and responsively generate and electronically transmit one or more component command signals to actuate the components of the hydraulic system 201 and/or the machine 100 (for example, the engine 202, the pump 206, the one or more valves 208) in a manner consistent with, and to effectuate, the operator's desired control and operation of the machine 100. The controller 222 can further process the one or more operator command signals as well as the resultant actuation of the components of the hydraulic system 201 and/or the machine 100 to determine the volume, flow, and/or amount of the hydraulic fluid 205 flowing through, utilized by, and/or retained within the components of the hydraulic system 201 external to the tank 128.

In particular, based upon, and utilizing, one or more of a commanded speed of the engine 202, a commanded speed and/or displacement of the pump 206, and/or one or more commanded positions or actuations of the one or more valves 208 (or combinations thereof) consistent with and as required by the operator command and commanded by the controller 222, the controller 222 can process, calculate, or otherwise determine an amount and/or flow of the hydraulic fluid 205 being drawn out of the tank 128, retained by, and/or in operative use within the hydraulic system 201 to effectuate the desired movement, positioning, and/or control of the machine 100 consistent as commanded by the operator. In order to do so, in one embodiment, the controller 222 can process the commanded movements, speeds, positions, and/or actuations of the components of the hydraulic system 201 and/or the machine 100 with reference to and in combination with flow and/or output ratings, volume and/or flow capacity, or other such performance and design data associated with any one or more of the components of the hydraulic system 100 as disclosed herein saved in the memory 223 of the controller 222.

The controller 222 can monitor, receive analyze, process, and/or otherwise utilize, and additionally, can record and store in the memory 223 associated therewith, one or more of, or various combinations of the sensed signals from the sensors as well as the commands and additional associated data as disclosed above according to any of the embodiments of the present disclosure and further disclosed herein upon startup of, during, and throughout use and operation of the machine 100 and the systems thereof (including, in part, the hydraulic system 201) to calculate, process, and/or otherwise determine an estimated pressure "PE" within the tank 128 representative of, consistent with, and/or equivalent to a pressure maintained and present within a healthy, properly functioning, undamaged tank 128 having healthy, properly functioning, undamaged components (including, in part, the breather valve assembly 130) at periodic intervals during the use and operation of the machine 100 which can be predetermined, set, and established based upon factors such as one or more of the type of machine 100, the operating environment of the machine 100, the tasks and conditions associated with the operation of the machine 100, the age of the machine 100 and the components thereof, and the like.

In response, and upon each determination of the estimated pressure "PE" within the tank 128 by the controller 222, the controller 222 can monitor and receive a signal indicative of the actual, sensed tank pressure signal of the pressure "P" within the tank 128, and compare the actual, sensed pressure "P" within the tank 128 with the estimated pressure "PE" representative of a pressure maintained and present within the healthy, properly functioning, undamaged tank 128. Based upon the comparison, the controller 222 can determine (as well as monitor, analyze, and/or predict) the health status of the tank 128 according to any of the embodiments as further discussed herein.

Upon startup of the machine 100 and initiation of the various systems thereof, including, in part, the hydraulic system 201, the health determination system 200 can be configured to obtain an initial status of the tank 128 as well as, in one or more embodiments, that of the hydraulic system 201 and components thereof, which can be saved within the memory 223 and utilized by the controller 222, in combination with subsequently sensed and/or determined measurements, to determine each estimated pressure "PE" within the tank 128. In particular, in one embodiment, the controller 222 can obtain and store (within the memory 223 associated therewith) the initial pressure of the hydraulic fluid 205 within the tank 128 ("$P_{tank,\ initial}$") which can be sensed and electronically communicated to the controller 222 from the first pressure sensor 210*a* upon startup of the machine 100. The controller 222 can use the initial pressure of the hydraulic fluid 205 within the tank 128 ("$P_{tank,\ initial}$") as a baseline or reference value in combination with each of the contemporaneously sensed, calculated, and/or determined temperature and volume measurements associated with the tank 128 (as well as, in certain embodiments, measurements associated with the hydraulic system 201, as disclosed herein) received and/or otherwise processed by the controller 222 during subsequent use and operation of the machine 100 and the systems thereof (including, in part, the hydraulic system 201) in order to determine each estimated pressure "PE" within the tank 128 according to any one or more of the embodiments as disclosed herein.

As provided above, in certain embodiments, the temperature of the tank 128 used by the controller 222 as an input to determine the estimated pressure "PE" within the tank 128 can be based, either directly or indirectly, upon sensed signals received from one or more of the temperature sensors 212, 212*a*, 212*b*, 212*c*. The volume of the tank 128 used by the controller 222 as an input to determine the estimated pressure "PE" within the tank 128, which, in one embodiment, can be a value indicative of the volume of air within the tank 128, can be based upon, calculated, or otherwise determined from one or more of signals received from one or more of the cylinder position sensors 214, the pump speed sensor 220, the hydraulic fluid sensors 217*a*, 217*b*, the fluid level sensor 402, and/or one or more operator command signals received from the actuated one or more input devices 218 (and, in one embodiment, the operator command sensors 216) according to any one or more of the embodiments as disclosed herein. Each estimated pressure "PE" within the tank 128 determined by the controller 222, as well as each of the contemporaneously sensed, calculated, and/or determined values or inputs indicative of the temperature and volume of the tank 128 used in connection therewith, can also be stored in the memory 223 of the controller 222.

The various sensed signals, commands, data, and other inputs as disclosed above and further disclosed herein can be processed by the controller 222 in combination with and/or based upon additional data, correlations, and/or algorithms (as disclosed below) stored within the memory 223 of the controller 222 and used thereby to determine the estimated pressure "PE" within the tank 128. In one embodiment, the estimated pressure "PE" within the tank 128 can be determined by the controller 222 based upon the controller 222 inputting, analyzing, referencing, and/or correlating the signals received from the sensors, including that of the initial pressure of the hydraulic fluid 205 within the tank 128 ("$P_{tank,\ initial}$") from the first pressure sensor 210*a*, the temperature of the tank 128 received from the temperature sensors 212, and one or more of: the position of the hydraulic cylinders 118 and/or 126 from one or more of the cylinder position sensors 214; the speed of the pump 206 from the pump speed sensor 220; one or more of a volume, flow, and/or amount of the hydraulic fluid 205 within the components of the hydraulic system 201 external to the tank 128 from hydraulic fluid sensors 217*a*, 217*b*; the amount or level (for example, height) at which the hydraulic fluid 205 fills the hollow interior 138 of the tank 128 from the fluid level sensor 402; and the operator command signals received from the actuated one or more input devices 218 (and, in one embodiment, the operator command sensors 216).

The signal indicative of the initial pressure of the hydraulic fluid 205 within the tank 128 ("$P_{tank,\ initial}$"), the one or more signals indicative of the temperature of the tank 128, as well as one or more of the additional signals indicative of the volume within the tank 128 as disclosed above and further disclosed herein may be compared to, correlated with, referenced to, or otherwise analyzed by the controller 222 based upon corresponding values in a data set, a lookup table, or model saved within the memory 223 of the controller 222 which can include one of a plurality of estimated pressure "PE" values which corresponds with and is established based on the foregoing sensor signal values and/or operator command input data, in addition to the curve 224, as further discussed herein. It should be understood that various combinations including greater or lesser sensor signal inputs received by the controller 222 as disclosed herein may be sufficient for the controller 222 to determine the estimated pressure "PE".

Additionally, or in an alternative embodiment, the controller 222 can, utilizing internal programming, processing, and/or control logic, and the like, apply and process the sensor signals corresponding to those disclosed above based on a correlation and as inputs into an algorithm stored in the memory 223 of the controller 222 to determine the estimated pressure "PE". The correlation and/or associated algorithm can include the controller 222 processing and analyzing the sensor signals based upon, and utilizing, a mathematical expression applied by the controller 222 and by which the controller 222 processes, calculates, or otherwise determines the estimated pressure "PE" as a function of, based upon, and/or otherwise utilizing inputs including the sensor signals received from the sensors or otherwise determined by the controller 222 (as discussed above) including the initial pressure of the hydraulic fluid 205 within the tank 128 "$P_{tank,\ initial}$" from the first pressure sensor 210*a*, one or more temperature signals received from one or more of the temperature sensors 212 as discussed according to any one or more of the embodiments disclosed above, as well as one or more of the sensor signals and/or operator commands received and/or utilized by the controller 222 as indicative of and/or determinant of the volume of the air "$V_{air}$" within the hollow interior 138 of the tank 128 to any one or more of the embodiments disclosed above using the following exemplary correlation:

$$PE_{tank} = \frac{M_{air} \times R_{air} \times T_{air}}{V_{air}}$$

Wherein, $$M_{air} = \int \dot{m}_{air} dt + \frac{P_{tank,\,initial} \times V_{air,\,initial}}{R_{air} \times T_{air}}$$

$$\dot{m}_{air} = \frac{\dot{V}_{air} \times P_a}{R_{air} \times T_a}$$

$$V_{air} = -\int Q dt + V_{air,\,initial}$$

$PE_{tank}$=estimated pressure within tank
$M_{air}$=mass of air present within tank
$R_{air}$=universal gas constant
$T_{air}$=temperature of air present within tank
$V_{air}$=volume of air present within tank
$\dot{m}_{air}$=mass flow rate of air through breather valve
$P_{tank,\ initial}$=initial pressure within tank
$V_{air,initial}$=initial volume of air present within tank
$P_a$=ambient pressure of air
$T_a$=ambient temperature of air It should be noted that the correlation and mathematical expression described herein is merely exemplary, and as such, additional or alternative inputs or data values may be used and/or additional or alternative calculations, expressions, and/or correlations may be applied based on application requirements, which are nonetheless consistent with, based upon, and equivalent to the foregoing as utilizing correlations and expressions which are fundamentally consistent with that of, and thus fall within the spirit and scope of the present disclosure.

It is also to be understood that the system 200 can include various configurations and may include fewer sensors connected in electronic communication with the controller 222. In an alternative variant of the present disclosure, the system 200, and, in part, the controller 222 thereof, can be configured to determine one or more estimated pressures "PE" within the tank 128 and compare each estimated pressure "PE" with a contemporaneous actual, sensed pressure "P" within the tank 128 to determine the health status of the tank 128 according to and consistent with any of the embodiments as further discussed herein, but can do by utilizing less sensors. In particular, an alternative embodiment of the system 200 is depicted and shown in FIG. 4 as system 400, wherein the system 400 determines each estimated pressure "PE" within the tank 128 an in a manner consistent with the system 200 by utilizing the initial pressure of the hydraulic fluid 205 within the tank 128 ("$P_{tank,\ initial}$") in combination with the sensed, calculated, and/or determined temperature and volume measurements associated with the tank 128; however, instead of determining the volume of the fluid within tank 128 (which, in one embodiment, is the air within the tank 128, or, alternatively, can be or include the hydraulic fluid 205 within the tank 128) based upon one or more, or various combinations of signals received from cylinder position sensors 214, the pump speed sensor 220, the hydraulic fluid sensors 217*a*, 217*b*, and/or one or more operator command signals received from more input devices 218/operator command sensors 216, either alone or in combination with the fluid level sensor 402, the system 400 is configured to determine the volume of the tank 128 based upon signals received from the fluid level sensor 402 alone.

As such, in the alternative embodiment of the system 400 as shown in FIG. 4, the cylinder position sensors 214, the pump speed sensor 220, and the hydraulic fluid sensors 217*a*, 217*b* may be omitted, but retains all of the other sensors as disclosed and included within system 200. As provided above, the system 400 can also determine each estimated pressure "PE" within the tank 128 an in a manner consistent with the system 200 as disclosed herein. In particular, and in an equivalent manner the signal indicative of the initial pressure of the hydraulic fluid 205 within the tank 128 ("$P_{tank,\ initial}$"), the one or more signals indicative of the temperature of the tank 128, as well the signal indicative of the volume within the tank 128 from the fluid level sensor 402 can be compared to, correlated with, referenced to, or otherwise analyzed by the controller 222 based upon corresponding values in a data set, a lookup table, or model saved within the memory 223 of the controller 222 which can include one of a plurality of estimated pressure "PE" which corresponds with and is established based on the foregoing sensor signal values, in addition to the curve 224. Additionally, or in an alternative embodiment, the controller 222 can, utilizing internal programming, processing, and/or control logic, and the like, apply and process the sensor signals corresponding to those disclosed above based on a correlation and as inputs into an algorithm stored in the memory 223 of the controller 222 to determine the estimated pressure "PE".

The correlation and/or associated algorithm can include the controller 222 processing and analyzing the sensor signals based upon, and utilizing, a mathematical expression applied by the controller 222 and by which the controller 222 processes, calculates, or otherwise determines the estimated pressure "PE" as a function of, based upon, and/or otherwise utilizing inputs including the sensor signals received from the sensors or otherwise determined by the controller 222 (as discussed above) including the initial pressure of the hydraulic fluid 205 within the tank 128 "$P_{tank,\ initial}$" from the first pressure sensor 210*a*, one or more temperature signals received from one or more of the temperature sensors 212 as discussed according to any one or more of the embodiments disclosed above, as well as one or more of the sensor signal indicative of the volume within the tank 128 from the fluid level sensor 402 indicative of and/or determinant of the volume of the air "$V_{air}$" within the hollow interior 138 of the tank 128 using the exemplary correlation in a manner equivalent with that as disclosed with reference to the system 200 above, in addition to the curve 224.

Figure 3:
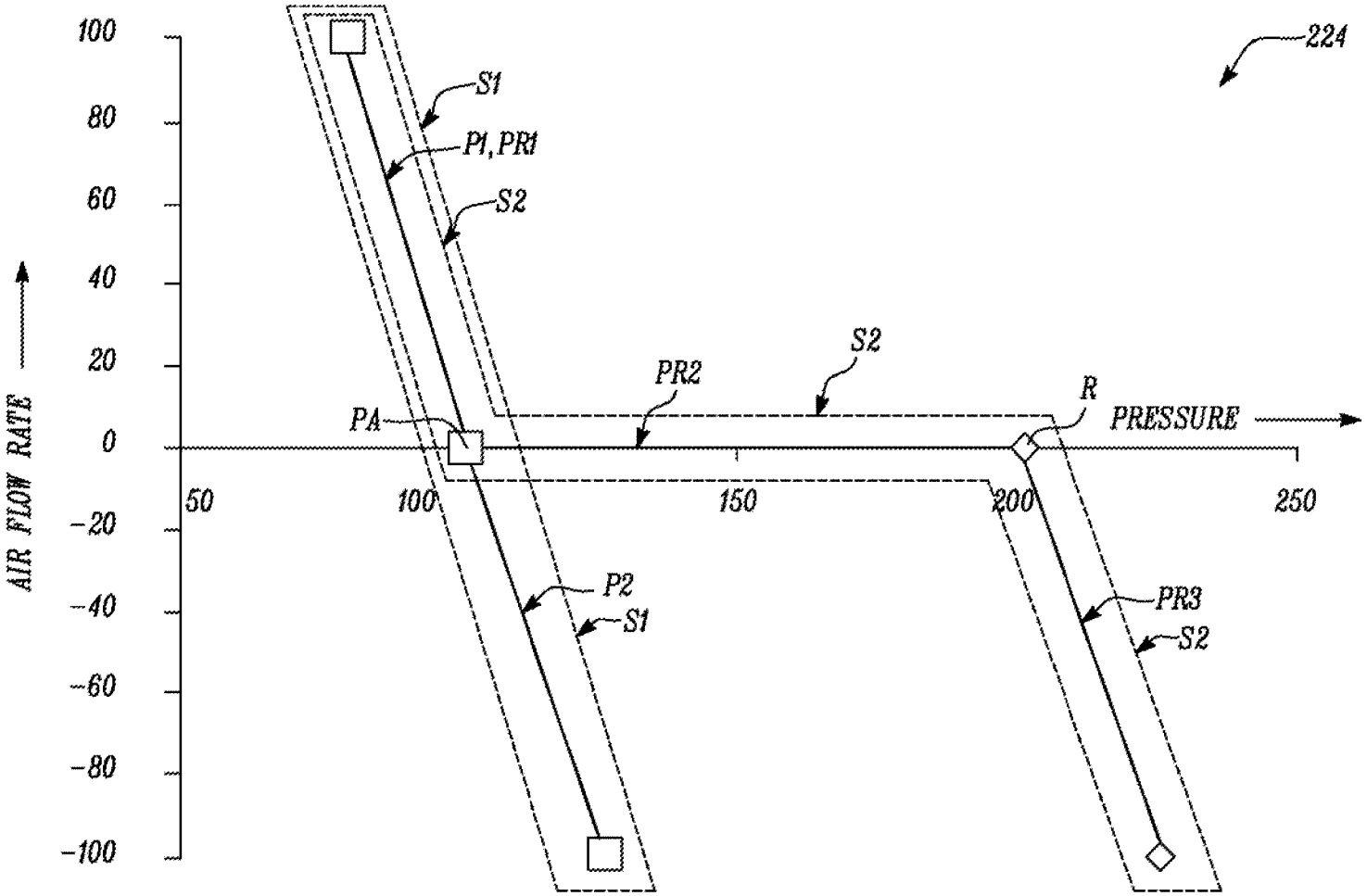
FIG. 3 is a graphical representation of an exemplary breather performance curve of a breather valve, according to one embodiment of the present disclosure.

The controller 222, in calculating the estimated pressure "PE" according to any of the embodiments described above including those as described with reference to FIGS. 2 and 4, can also reference and apply a model which is indicative of and/or characterizes the expected behavior and/or performance of a properly functioning breather valve 130, and/or otherwise represents the manner in which the behavior and/or performance of the breather valve 130, as well as the type thereof, can modify, and/or otherwise affect and be used to determine the estimated pressure "PE" value which can be representative of a healthy, properly functioning, undamaged tank 128 having a healthy, properly functioning, undamaged breather valve 130 based upon the specific conditions under which the tank 128 is operating and subject to. The model can be in the form of a correlation chart, data or lookup table, or other similar or suitable form of data and/or data processing algorithm stored in the memory 223 of the controller 222, which includes expected tank 128 pressure values (and limits) as a function of, and/or as affected or modified by air flow rates based upon the type and expected behavior and/or performance of a properly functioning breather valve 130. FIG. 3 provides a non-limiting graphical representation and characterization of one example of such model, illustrated and referred to herein as breather performance curve 224 (or "curve 224").

Referring to FIG. 3, a segment "S1" of the curve 224 indicates performance of the breather valve 130 without a relief setting. A portion "P1" of the segment "S1" indicates the flow of air into the tank 128 through the breather valve 130 when the pressure within the tank 128 may be below the ambient pressure "$P_a$". Also, a portion "P2" of the segment "S1" indicates the flow of air out the tank 128 through the breather valve 130 when the pressure within the tank 128 may be above the ambient pressure "$P_a$".

A segment "S2" of the curve 224 indicates performance of the breather valve 130 with a relief setting "R". A portion "PR1" of the segment "S2" indicates the flow of air into the tank 128 through the breather valve 130 when the pressure within the tank 128 may be below the ambient pressure "$P_a$". A portion "PR2" of the segment "S2" indicates restriction of the flow of air into or out of the tank 128 when the pressure within the tank 128 may be between the ambient pressure "$P_a$" and the relief setting "R". A portion "PR3" of the segment "S2" indicates the flow of air out the tank 128 through the breather valve 130 when the pressure within the tank 128 may be above the relief setting "R". It should be noted that the curve 224 described herein and values associated therewith as illustrated in FIG. 3 are merely exemplary. As such, the configuration and values related to the curve 224 can vary based upon the specific characteristics, attributes, and/or configurations of, in part, the breather valve 130 and/or the tank 128.

The breather performance curve 224 can be referenced and applied by the controller 222 to the estimated pressure "PE" as determined according to any of the foregoing calculation models and embodiments as disclosed above, and can be referenced and applied by the controller 222 to modify, affect, or otherwise further process the calculation and determination of the of the estimated pressure "PE". The breather performance curve 224 (or data and/or processing representing the same, as discussed above) can be referenced from the memory 223 by the controller 222 and applied by the controller 222 to modify or adjust each estimated pressure "PE" value following the determination thereof via any of the embodiments as disclosed herein, referred to for the purposes of the present discussion as the "initial determined estimated pressure 'PE' value", to further process and define each initial determined estimated pressure 'PE' value based upon, and as affected by, the breather performance curve 224 as representing the expected behavior and/or performance of a properly functioning breather valve 130, referred to for the purposes of the present discussion as the "final estimated pressure 'PE' value".

In particular, the controller 222 can reference the curve 224 (as well as the applicable segment S1, S2 thereof based upon the type/performance characteristics of the breather valve 130 utilized with the tank 128 (e.g., with/without a relief setting) and process, as well as, if necessary, modify or adjust the initial determined estimated pressure "PE" value to the final estimated pressure "PE" value based upon, and/or as fitting within a correlating portion or area of the curve 224. While it should be understood that some initial determined estimated pressure "PE" values may not require adjustment based upon the segments of the curve 224 and thus the initial determined estimated pressure "PE" value will be equivalent to the final estimated pressure "PE" value, in one example, and with reference to FIG. 3, for initial determined estimated pressure "PE" values which may exceed the pressure value boundary of the breather performance curve 224 of the particular breather valve 130 (illustrated as S1, S2 in FIG. 3), the controller 222 may adjust the initial determined estimated pressure "PE" value to a final estimated pressure "PE" value as a value which may be at or close to the maximum pressure of the applicable segment S1, S2 of the breather performance curve 224. In alternative embodiments, the controller 222 may apply and integrate the breather performance curve 224 and the associated processing in a manner consistent with that as discussed above into and concurrently with the controller's 222 determination of each estimated pressure "PE" according to any of the foregoing calculation models.

Referring to FIGS. 2, 3, and 4, upon, prior to, concurrently with, or otherwise within a substantially proximate period of time which, in one example, is less than one minute, within the controller's 222 calculation of each estimated pressure "PE" value according to any of the embodiments disclosed herein, the controller 222 can obtain a contemporaneous actual, sensed pressure "P" of the hydraulic fluid 205 within the tank 128 which can be sensed and electronically communicated to the controller 222 from the first pressure sensor 210*a*, and can compare the actual, sensed pressure "P" of the hydraulic fluid 205 with the estimated pressure "PE" value and determine the health status of the tank 128 based upon the comparison. The controller 222 determines a difference between each estimated pressure "PE" value calculated by the controller 222 and a contemporaneously sensed, actual pressure "P" of the hydraulic fluid 205 within the tank 128, wherein the controller 222 can determine the health status of the tank 128 based upon the extent or measure by which a sensed pressure "P" of the hydraulic fluid 205 within the tank 128 sensed subsequent to the startup, and in one embodiment, during use and operation of the machine 100 and the systems thereof (including, in part, the hydraulic system 201) deviates from the estimated pressure "PE" which is calculated by the controller 222 and representative of, consistent with, and/or equivalent to an expected pressure maintained and present within a healthy, properly functioning, undamaged tank 128 at a time and under conditions concurrent with the actual pressure "P" of the hydraulic fluid 205 within the tank 128 is sensed and transmitted to the controller 222.

The controller 222, based upon processing and analysis of the comparison, can determine the health status of the tank 128. In particular, if an actual, sensed pressure "P" of the hydraulic fluid 205 within the tank 128 is equivalent to, nearly equivalent to, or within a predetermined range or tolerance of the estimated pressure "PE" as representing and consistent with an expected pressure maintained and present within a healthy, properly functioning, undamaged tank 128 consistent with the time and corresponding conditions at and under which the actual, sensed pressure "P" is received, the controller 222 can determine, and in one embodiment, output the health status of the tank 128 as healthy, functioning properly, acceptable, or the like. In such a situation, the controller 222 may responsively generate, output, and electronically transmit a corresponding indication of the healthy, functioning properly, acceptable status of the tank 128 to the operator, such as, to the operator console display unit 204. In another embodiment, in such a situation, the controller 222 may take no action in response.

Alternatively, if an actual, sensed pressure "P" of the hydraulic fluid 205 within the tank 128 deviates from, or is beyond a predetermined range or tolerance of the estimated pressure "PE" as representing and consistent with an expected pressure maintained and present within a healthy, properly functioning, undamaged tank 128 consistent with the time and corresponding conditions at and under which the actual, sensed pressure "P" is received, the controller 222 can take any one or more of a variety of actions as further disclosed according to any one or more of the embodiments as disclosed herein, which can be based upon a variety of factors, including, but not limited to, the extent or range of deviation between the actual, sensed pressure "P" and the estimated pressure "PE". Alternatively, or additionally, the one or more actions taken by the controller 222 can be based upon a rate or trend of deviations between two or more successive comparisons between corresponding and contemporaneous actual, sensed pressures "P" and determined estimated pressures "PE" within a period of time, as further disclosed herein.

In one embodiment, the controller 222, based upon processing and analysis of a comparison between an actual, sensed pressure "P" and a corresponding estimated pressure "PE", and/or multiple such comparisons, can determine the health status of the tank 128 which can include one or more health status designations. The health status designations determined by the controller 222 can also be associated with predetermined, corresponding actions which can be taken by the controller 222 and stored in the memory 223 thereof in response to and upon the controller's 222 determination of the health status designation of the health status of the tank 128. The health status designations include at least a healthy status and a warning status, and can include one or more additional statuses, including but not limited to a caution status.

As discussed above a healthy status can be determined by the controller 222 in response to an actual, sensed pressure "P" of the hydraulic fluid 205 within the tank 128 being equivalent to, nearly equivalent to, or within a predetermined range or tolerance (as discussed herein) of the estimated pressure "PE", and in such case, the controller 222 can generate a corresponding indication of the healthy, functioning properly, acceptable status to the operator, such as, to the operator console display unit 204, or may alternatively, take no action. A warning status can be determined and generated by the controller 222 in response to a measure or extent of a deviation value (such as, e.g., within a threshold range) between an actual, sensed pressure "P" and an estimated pressure "PE" being indicative of probable, impending, likely, and/or actual damage to the tank 128 and/or the breather valve 130 thereof. In addition, in one embodiment, the warning status can also be determined and generated by the controller 222 in response to increasing successive deviations between two or more successive comparisons between corresponding and contemporaneous actual, sensed pressures "P" and determined estimated pressures "PE" approaching a deviation value (or, in one embodiment, approaching a deviation value within a threshold range, as discussed below) indicative of probable, impending, likely, and/or actual damage to the tank 128 and/or the breather valve 130 within a predetermined period of time.

In response to the controller's 222 determination of a warning health status designation of the health status of the tank 128, the controller 222 can responsively generate, output, and electronically transmit a corresponding indication of the warning status to the operator, such as, to the operator console display unit 204, as further disclosed herein. In addition, response to the controller's 222 determination of a warning health status designation of the health status of the tank 128, the controller 222 can further generate and electronically transmit one or more command signals to one or more components of the hydraulic system 201 to deactivate or otherwise control the actuation thereof in order to prevent any damage thereto. In one embodiment, the controller 222 can generate and electronically transmit one or more command signals to deactivate the operation the pump 206 or actuate the displacement of the pump 206 to a zero displacement mode, or any other mode which may prevent damage to the pump 206, such as cavitation, and/or to prevent any damage to any further downstream components of the hydraulic system 201 in response to probable, impending, likely, and/or actual damage to the tank 128 and/or the breather valve 130, including but not limited to an inability to retain supply hydraulic fluid 205 therein (e.g., leakage) or otherwise adequately or effectively supply hydraulic fluid 205 to the hydraulic system 201.

In response to the determination of a warning health status designation as discussed above which may be indicative of probable, impending, likely, and/or actual damage to the tank 128 the controller 222 may also generate and electronically transmit one or more command signals to the one or more valves 208 to actuate the one or more valves 208 in a "safe" mode or position, which in one example, can include actuating the one or more valves 208 to close or otherwise block and prevent a flow of hydraulic fluid 205 from the hydraulic cylinders 118, 126 through the third conduit 211 to the tank 128 such that an amount of hydraulic fluid 205 may be retained within the hydraulic cylinders 118, 126 which may prevent a sudden loss of pressure and any accompanying movement of the one or more hydraulic cylinders 118, 126.

The health status designations can include one or more additional status determinations, which can include a caution status determined by the controller 222. A caution status can be determined and generated by the controller 222 in response to a measure or extent of a deviation between an actual, sensed pressure "P" and an estimated pressure "PE", or alternatively, successive deviations between two or more successive comparisons between corresponding and contemporaneous actual, sensed pressures "P" and determined estimated pressures "PE", corresponding to a value or within a range of values greater than, outside of, or beyond the value or range of values which correspond to the healthy determination, but below or otherwise not great enough of a deviation to as that indicative of probable, impending, likely, and/or actual damage to the tank 128 and/or the breather valve 130 thereof.

In response to the controller's 222 determination of a caution health status designation of the health status of the tank 128, the controller 222 can responsively generate, output, and electronically transmit a corresponding indication of the warning status to the operator, such as, to the operator console display unit 204, as further disclosed herein. In addition, in response to the controller's 222 determination of a caution health status designation of the health status of the tank 128, the controller 222 can further generate and electronically transmit one or more command signals to one or more components of the hydraulic system 201 which may limit or otherwise control the actuation thereof in order to permit the continued operation of the hydraulic system 201 and the components thereof, in response to one or more deviation values indicative of a tank 128 and/or breather valve 130 which may not be healthy, functioning properly, or undamaged, but at the same time not indicative of probable, impending, likely, and/or actual damage. In one embodiment, the controller 222 can generate and electronically transmit one or more command signals to limit the operation the pump 206, such as to limit the speed and/or displacement thereof within a predetermined range below the maximum speed and/or displacement, wherein the extent to which the controller 222 may limit the speed and/or displacement below the maximum speed and/or displacement may be proportional to the extent or range by which the deviation value deviates from a healthy range.

The controller 222 may also generate and electronically transmit one or more command signals to the one or more valves 208 to actuate the one or more valves 208 in a mode or position configured to retain hydraulic fluid 205 within the hydraulic system 201 external to the tank 128, which in one example, can include actuating the one or more valves 208 to limit a flow of hydraulic fluid 205 from the hydraulic cylinders 118, 126 through the third conduit 211 to the tank 128 such that an amount of hydraulic fluid 205 may be retained within the hydraulic cylinders 118, 126 upstream of the tank 128 (e.g., including within the accumulator 215) which may facilitate the continued operation thereof in response to a limited supply of hydraulic fluid 205 thereto. Following the controller's 222 determination of a caution health status designation of the health status of the tank 128, the controller 222 can continue to receive, process, analyze, and compare and record in the memory 223 thereof subsequent sensed pressures "P" and corresponding estimated pressures "PE".

Upon one or more, or in another example, at least two subsequent deviation values returning to a value or range corresponding to those of a healthy determination, the controller 222 can responsively generate and electronically transmit one or more command signals to the one or more components of the hydraulic system 201, including but not limited to the pump 206 and/or the one or more valves 208 to return the same to full, unlimited, or otherwise normal operation. Alternatively, upon a subsequent deviation value indicative of probable, impending, likely, and/or actual damage to the tank 128 and/or the breather valve 130 thereof and the controller's 222 determination of a warning health status, the controller 222 can take the associated responsive actions as discussed above, including but not limited to generating and electronically transmitting one or more command signals to one or more components of the hydraulic system 201 to deactivate or otherwise control the actuation thereof in order to prevent any damage thereto.

In one embodiment, as discussed above, the controller's 222 determination of the health status designations of the health status of the tank 128 can be based upon and can correspond with threshold ranges. In particular, the controller 222 can include threshold ranges stored in the memory 223 associated therewith, wherein the controller 222 can compare and calculate the extent to which a sensed pressure "P" deviates from an estimated pressure "PE", determine the health status of the tank 128, and can generate the health status of the tank 128 determination and the health status designation based upon and corresponding to the values of threshold range into which the deviation value is categorized, as further disclosed herein. For example, the controller 222 can include a first threshold "T1", a second threshold "T2", and a third threshold "T3", wherein each threshold can include a range of values which can be defined as percentage values by which a sensed pressure "P" deviates from an estimated pressure "PE".

The first threshold "T1" can include the smallest range of deviation values, the third threshold "T3" can include a maximum range of deviation values, and the second threshold "T2" can include an intermediate range of deviation values which can include values in between the upper limit value of the first threshold "T1" and the lower limit value of the third threshold "T3". In one example, first threshold "T1" can include a range of values between a zero percent (0%) deviation and a three percent (3%) deviation between a sensed pressure "P" value and an estimated pressure "PE" value. In another example, the first threshold "T1" can include a range of deviation values between zero percent (0%) and five percent (5%) deviation. In yet another example, the first threshold "T1" can include a range of deviation values between zero percent (0%) and ten percent (10%) deviation. The second threshold "T2" can include an intermediate range of deviation values, which may, in one example, be in a range between three percent (3%) deviation to ten percent (109%) deviation. In another example, the second threshold "T2" can include a range of deviation values between one of three percent (3%) and five percent (5%) deviation to fifteen percent (15%) deviation.

In yet another example, the second threshold "T2" can include a range of deviation values between one of three percent (3%), five percent (5%), and ten percent (10%) deviation to one of a twenty percent (20%) deviation and a thirty percent (30%) deviation. Finally, the third threshold "T3" can include a maximum range of deviation values, which may, in one example, include deviation between a sensed pressure "P" value and an estimated pressure "PE" value of ten percent (10%) or more. In another example, the third threshold "T3" can include a maximum range of deviation values which includes deviations between a sensed pressure "P" value and an estimated pressure "PE" value of fifteen percent (15%) or more. In still further examples, the third threshold "T3" can include a range of deviations of twenty percent (20%) or more, or alternatively, thirty percent (30%) or more. It should be understood that the number of threshold ranges, as well as the associated value ranges as disclosed above, are merely exemplary, as fewer, or greater threshold ranges having differing value ranges are contemplated and included as falling within the spirit or scope of the present disclosure, which may be based, in part, on factors such as the age, type, operating environment, configuration, and/or operational parameters and capabilities of the machine 100, the hydraulic system 201, and/or the components thereof.

As provided above, following the initial pressure of the hydraulic fluid 205 within the tank 128 ("$P_{tank,\ initial}$") which can be sensed and electronically communicated to the controller 222 from the first pressure sensor 210*a* upon startup of the machine 100, the health determination system 200, including, in part, the controller 222 thereof, can obtain the sensor signals and perform the processing as disclosed according to any of the embodiments as disclosed herein to determine at least one health status of the tank 128 based upon a comparison between a contemporaneously calculated and sensed estimated pressure "PE" and actual, sensed pressure "P" of the hydraulic fluid 205 within the tank 128. In one embodiment, deviation values calculated by the controller 222 based upon the comparison between a contemporaneously calculated and sensed estimated pressure "PE" and actual, sensed pressure "P" of the hydraulic fluid 205 within the tank 128 which fall within the first threshold "T1" can correspond to and result in the controller's 222 determination and generation of a healthy status designation of the health status of the tank 128, as disclosed above.

Additionally, any deviation value calculated by the controller 222 which falls within the value range of the third threshold "T3" can correspond to and result in the controller's 222 determination and generation of a warning status designation of the health status of the tank 128, as well as the associated, corresponding actions taken by the controller 222 as disclosed according to any of the embodiments above. Furthermore, in one embodiment, a deviation value calculated by the controller 222 which falls within the value range of the second threshold "T2" can correspond to and result in the controller's 222 determination and generation of a caution status designation of the health status of the tank 128, as well as the associated, corresponding actions taken by the controller 222 as disclosed according to any of the embodiments above. However, additionally, or alternatively, two or more successive deviation values within the value range of the second threshold "T2" may result in the controller's 222 determination and generation of a warning status designation.

Following the controller 222 obtaining and storing the initial pressure of the hydraulic fluid 205 within the tank 128 ("$P_{tank,\ initial}$") in the memory 223 associated therewith upon initial startup of the machine 100, the controller 222 can monitor and receive signals from one or more of the plurality of sensors as well as commands and additional associated data to calculate, process, and/or otherwise determine an estimated pressure "PE" according to any of the embodiments of the present disclosure as disclosed above, monitor and receive a contemporaneously sensed signal indicative of the actual tank pressure signal of the pressure "P" within the tank 128 corresponding to the estimated pressure "PE", and determine the health status of the tank 128 based upon the comparison therebetween, which can be based upon a deviation value calculated by the controller 222 indicative of the extent or range of deviation between the actual, sensed pressure "P" and the estimated pressure "PE".

The controller 222, via programming or other settings stored in the memory 223 or otherwise resident within and/or utilized by the controller 222, can be programmed to monitor, process, calculate, and store a series of individual, corresponding, associated, and contemporaneously sensed, calculated, and determined actual pressures "P", estimated pressures "PE", deviation values, and associated health status designations of the health status of the tank 128 in the memory 223 thereof at periodic intervals which may be predetermined, set, and established based upon factors such as one or more of the type of machine 100, the operating environment of the machine 100, the tasks and conditions associated with the operation of the machine 100, the age of the machine 100 and the components thereof, and the like.

Furthermore, via programming or other settings stored in the memory 223 or otherwise resident within and/or utilized by the controller 222 which can further include a timer, the controller's 222 determination of each health status of the tank 128, and responsive actions as discussed above, can further be based upon a comparison between a currently determined and calculated health status of the tank 128 and one or more preceding health status designations of the health status of the tank 128. If a current, or first comparison between a contemporaneously calculated and sensed estimated pressure "PE" and actual, sensed pressure "P" of the hydraulic fluid 205 within the tank 128 results in a deviation value which falls within the first threshold "T1", the controller 222 can determine, generate, and record the health status of the tank 128 as corresponding to a healthy status designation, and can be configured to take the appropriate responsive actions which correspond thereto as according to the embodiment discussed above.

In response to a healthy status designation, as well as any subsequent healthy status designation as determined by the controller 222, the controller 222 can be configured to maintain the normal operation of the machine 100 as well as the systems thereof as disclosed above, and can further continue to monitor sensed signals and perform the calculations as discussed herein to calculate subsequent determinations of the health status of the tank 128 according to and based upon the predetermined interval as discussed above. If a subsequent or second comparison between a contemporaneously calculated and sensed estimated pressure "PE" and actual, sensed pressure "P" of the hydraulic fluid 205 within the tank 128 results in a deviation value which falls within the second threshold "T2" following an immediately preceding, stored healthy status designation, the controller 222 can determine, generate, and record in the memory 223 associated with the controller 222 the health status of the tank 128 as corresponding to a caution status designation (and can further record a time or other similar designation representing the time or interval of the caution status determination, as well as each of the other health status designations determined throughout the operation of the machine 100), and can send the signals to take any one or more of the corresponding actions in response thereto according to any one or more of the embodiments as discussed above.

If, at any time, a comparison between a contemporaneously calculated and sensed estimated pressure "PE" and actual, sensed pressure "P" of the hydraulic fluid 205 within the tank 128 results in a deviation value which falls within the third threshold "T3", the controller 222 can determine, generate, and record in the memory 223 associated with the controller 222 the health status of the tank 128 as corresponding to a warning status designation, and can send the signals to take any one or more of the corresponding actions in response thereto according to any one or more of the embodiments as discussed above. However, two or more successive deviation values which fall within the second threshold "T2" may also result in the controller's 222 determination of a warning status designation, including but not limited to instances of two or more successive deviation values which may fall within the second threshold "T2", but are indicative of a rapid rise in deviation away from a value or range corresponding to a healthy status, and toward the warning status designation range, as disclosed herein.

If a subsequent or third comparison results in a deviation value which falls within the second threshold "T2" following an immediately preceding, or second stored caution status designation, the controller 222 may determine, generate, and record in the memory 223 associated with the controller 222 the health status of the tank 128 as corresponding to a caution status designation, or may determine, generate, and record in the memory 223 associated with the controller 222 the health status of the tank 128 as corresponding to a warning status designation, and can send the respective signals to take any one or more of the corresponding, respective actions in response thereto according to any one or more of the embodiments as discussed above.

In particular, in one embodiment, if a subsequent or third comparison results in a deviation value within an upper range of the second threshold "T2", such as, in one example, in the upper third of the second threshold "T2" following a second, or two or more immediately preceding, successive, stored deviation values within a lower range of the second threshold "T2", such as, in one example, in the bottom third of the second threshold "T2", the controller 222 may responsively determine, generate, and record in the memory 223 associated with the controller 222 the health status of the tank 128 as corresponding to a warning status designation. In addition, or alternatively, the controller 222 may determine, generate, and record in the memory 223 associated with the controller 222 the health status of the tank 128 as corresponding to a warning status designation following a second, or two or more immediately preceding, successive, stored deviation values within the upper range of the second threshold "T2", such as, in one example, in the upper third of the second threshold "T2". However, the controller 222 may determine, generate, and record in the memory 223 associated with the controller 222 the health status of the tank 128 as corresponding to the caution status designation following a second, or two or more immediately preceding, successive, stored deviation values within the lower range of the second threshold "T2".

Upon any caution status designation of the health status of the tank 128, the controller 222 can continue to monitor sensor signals as well as any other actions necessary to calculate subsequent expected pressure "PE" determinations according to any of the embodiments discussed above as well as monitor and receive actual (e.g., not estimated) sensed pressures "P" within the tank 128 contemporaneous therewith as necessary to calculate subsequent determinations of the health status of the tank 128 according to and based upon the predetermined interval as discussed above. Following one or more immediately preceding, successive stored caution status designations as discussed according to any one of the embodiments above, if a subsequent monitored and calculated difference between an expected pressure "PE" and an associated actual sensed pressure "P" results in a deviation value returning to within the first threshold "T1", the controller 222 generate and record in the memory 223 associated with the controller 222 the health status of the tank 128 as corresponding to a healthy status designation, and, in response, can send the signals to return the machine 100 and the hydraulic system 201 to normal operation as discussed above. Alternatively, the controller 222 may require at least two subsequent, successive calculated deviation values returning to within the first threshold "T1" following one or more immediately preceding, successive stored caution status designations before designating the health status of the tank 128 as corresponding to a healthy status designation and returning the machine 100 and the hydraulic system 201 to normal operation as discussed above.

In another embodiment, the controller 222 may determine a number of instances of deviation values between estimated pressures "PE" and the sensed pressures "P" exceed the first threshold "T1" within a first predetermined amount of time. The controller 222 may compare the number of instances with respect to the second threshold "T2". If the number of instances of calculated deviation values exceed the second threshold "T2" within the first predetermined amount of time, the controller 222 may designate the health status of the tank 128 as corresponding to a warning status designation and take the responsive, corresponding actions according to any of the embodiments as discussed above.

In another embodiment, the controller 222 may determine a rate of change of successive deviation values between sensed pressures "P" and estimated pressures "PE" within a second predetermined amount of time. The second predetermined amount of time may be different or equal to the first predetermined amount of time. If a rate of change of any calculated deviation value exceeds a previous, successive calculated deviation value by a threshold of twenty percent (20%) or more, or alternatively, thirty percent (30%) or more within second predetermined amount of time, the controller 222 may designate the health status of the tank 128 as corresponding to a warning status designation and take the responsive, corresponding actions according to any of the embodiments as discussed above.

It should be noted that the health status, and in particular, a warning status, and/or, in some circumstances, a caution status as discussed above, of the tank 128 may be indicative of various operating conditions of the tank 128. For example, in a situation of an air leakage or fluid leakage on the tank 128, the tank 128 may be unable to maintain a desired pressure range therein. In such a situation, the health status of the tank 128 may be indicative of a faulty, leaking, damaged, and/or broken tank 128, based on application requirements. In another situation, when the tank 128 may be over filled with the hydraulic fluid 205, the pressure within the tank 128 may be above the desired pressure range. In such a situation, the health status of the tank 128 may be indicative of excessive fluid within the tank 128, based on application requirements. In yet another situation, when there may be an air leakage or fluid leakage or faulty operation of other components associated with the tank 128, such as one or more fluid lines, couplings, pump, and so on, the tank 128 may be unable to maintain the desired pressure range therein. In such a situation, the health status of the tank 128 may be indicative of a faulty, leaking, damaged, and/or broken component associated with the tank 128.

Also, in some embodiments, the health status of the tank 128, and in particular, a warning status, and/or, in some circumstances, a caution status as discussed above, may be indicative of the health status of the breather valve 130. For example, in a situation when the tank 128 may be unable to maintain the desired pressure range, the health status may be indicative of a faulty, leaking, damaged, and/or broken breather valve 130, based on application requirements. In another situation, when the pressure within the tank 128 may be above the desired pressure range, the health status may be indicative of a faulty, plugged, damaged, and/or broken breather valve 130, based on application requirements. It should be noted that the health status of the tank 128 and/or the breather valve 130 described herein is merely exemplary, may vary and/or include other conditions based on application requirements.

Further, the controller 222 is configured to indicate the health status of the tank 128 through the operator console display unit 204. More specifically, the controller 222 generates a signal indicative of the health status of the tank 128 based on the determination of the health status, as disclosed above. The signal indicative of the health status of the tank 128 can further be electronically communicated by the controller 222 to the operator console display unit 204 configured to display and/or otherwise indicate the health status of the tank 128 to an operator of the machine 100 consistent with and in in response to the signal communicated thereto by the controller 222.

In such a situation, the health status may be indicated using one or more visual indicators of, or included in the operator console display unit 204, including, but not limited to, alphanumerical characters, a warning/malfunction icon, and a Light Emitting Diode (LED) icon. In some embodiments, the health status may be indicated using one or more audible indicators provided by the operator console display unit 204, including, but not limited to, a siren, a beep, and a voice message. In some situations, if the controller 222 determines that the tank 128 is unhealthy, (e.g., a warning health status), the controller 222 can send a signal to one or more of the pump 206, valves 208, and the like, in order to change an operation thereof or shut them down in order to avoid damage to the hydraulic system 201 and/or the components thereof according to any one or more of the embodiments as discussed above.

As provided above, following the initial pressure of the hydraulic fluid 205 within the tank 128 ("$P_{tank,\ initial}$") which can be sensed and electronically communicated to the controller 222 from the first pressure sensor 210*a* upon startup of the machine 100, the health determination system 200, including, in part, the controller 222 thereof, can obtain the sensor signals and perform the processing as disclosed according to any of the embodiments as disclosed herein to determine at least one health status of the tank 128 based upon the comparison between a contemporaneously calculated and sensed estimated pressure "PE" and actual, sensed pressure "P" of the hydraulic fluid 205 within the tank 128. In another embodiment, the controller 222 can determine one or more, or a plurality of determinations of the health status of the tank 128 each based upon the comparison between a corresponding, contemporaneously calculated and sensed estimated pressure "PE" and actual, sensed pressure "P" during the use and operation of the machine 100 which may be at periodic intervals which may be predetermined, set, and established based upon factors such as one or more of the type of machine 100, the operating environment of the machine 100, the tasks and conditions associated with the operation of the machine 100, the age of the machine 100 and the components thereof, and the like.

INDUSTRIAL APPLICABILITY

The system 200, 400 provides a simple, effective, and cost-effective method for determining the health status of the tank 128. The system 200, 400 provides the health status of the tank 128 to the operator which may provide an indication for timely inspection, repair and/or replacement of the tank 128 and/or the breather valve 130. As such, damage to the tank 128 and/or one or more components associated with the tank 128 and the hydraulic system 200, such as a motor, the pump 206, the hydraulic cylinders 118, 126, as well as any other associated components of the machine 100 and/or hydraulic system 201 thereof, which may require accurate tank pressures for efficient functioning thereof, may be limited, if not prevented, due to the ability of the system 200, 400 to provide timely notice of a faulty tank 128 and/or the breather valve 130, as discussed herein. This may, in turn, reduce maintenance/service cost, machine downtime, warranty claim, as well as additional benefits as understood by one or ordinary skill in the art upon attaining an understanding of the teachings of the present disclosure.

Also, providing the operator with the indication of the health status of the tank 128, and the prompt, expedient notification of the same, such notice may allow for and result in the ability to take corrective actions to limit leakage of the hydraulic fluid 205 from the tank 128, leakage of air into the tank 128, infiltration of contamination within the tank 128, low inlet pressure at the pump 206, and limit over pressurization of the tank 128 due to over filling of the hydraulic fluid 205 therein, as well as others which may be caused as a result of a broken/faulty tank 128 and/or the breather valve 130 which, without such notification, may result in substantial damage to the tank 128 as well as the additional components of the hydraulic system 201 as discussed above.

Also, the system 200, 400 includes components that may already exist on the machine 100 such as the pressure sensor 210, the temperature sensor 212, the cylinder position sensor 214, the operator command sensor 216, the engine pump sensor 220, the fluid level sensor 402, the operator console display unit 204, and/or the controller 222. As such, the system 200, 400 may be installed in any machine with little or no modification to the existing system.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A system for determining a health status of a tank, the system comprising:

a hydraulic system including the tank and at least one hydraulic actuator, the hydraulic actuator coupled in fluid communication with a fluid within the tank;

one or more sensors coupled to the tank, the one or more sensors including a temperature sensor and a pressure sensor;

at least one sensor coupled to the at least one hydraulic actuator, the at least one sensor configured to sense an amount of the fluid within the at least one hydraulic actuator;

a breather valve coupled to the tank; and a controller controllably connected to the at least one hydraulic actuator and connected in electronic communication with an operator console display unit, the one or more sensors coupled to the tank, and the at least one sensor coupled to the at least one hydraulic actuator, the controller configured to:

receive a signal indicative of a temperature of the fluid within the tank from the temperature sensor;

receive a signal indicative of a volume of the fluid within the tank from the at least one sensor coupled to the at least one hydraulic actuator;

determine an estimated pressure of the fluid within the tank based on the signal indicative of the temperature of the fluid within the tank received from the temperature sensor and the signal indicative of the volume of the fluid within the tank received from the at least one sensor coupled to the at least one hydraulic actuator and a breather performance curve associated with the breather valve;

receive a signal indicative of a pressure of the fluid within the tank from the pressure sensor;

compare the estimated pressure with the pressure of the fluid within the tank;

determine the health status of the tank based on the comparison; and actuate one or more of the operator console display unit and the at least one hydraulic actuator based upon the determined health status of the tank.

2. The system of claim 1, wherein the determination of the health status further includes:

determining if a difference between the estimated pressure and the pressure of the fluid exceeds a first threshold; and determining the health status of the tank based, at least in part, on the difference exceeding the first threshold.

3. The system of claim 2, wherein the determination of the health status further includes:

determining a number of instances the difference between the estimated pressure and the pressure of the fluid exceeds the first threshold within a predetermined amount of time; and determining the health status of the tank based, at least in part, on the number of instances exceeding a second threshold.

4. The system of claim 1, wherein the determination of the health status further includes:

determining if a rate of change of the pressure of the fluid with respect to the estimated pressure within a predetermined amount of time exceeds a third threshold; and determining the health status of the tank based, at least in part, on the rate of change of the pressure of the fluid exceeding the third threshold.

5. The system of claim 1, wherein the controller is further configured to:

monitor the pressure of the fluid within the tank;

compare the pressure of the fluid with a pressure threshold range;

determine the health status of the tank based, at least in part, on the comparison; and indicate the health status of the tank through the operator console.

6. The system of claim 1, wherein the breather performance curve includes an air flow rate through the breather valve based on the pressure of the fluid within the tank.

7. The system of claim 1, wherein the tank is a hydraulic tank and the fluid is a hydraulic fluid.

8. A system for determining a health status of a tank, the system comprising:

a hydraulic system including the tank and at least one hydraulic actuator, the hydraulic actuator coupled in fluid communication with a fluid within the tank;

one or more sensors coupled to the tank, the one or more sensors including a fluid level sensor and a pressure sensor;

a breather valve coupled to the tank; and a controller connected in electronic communication with an operator console display unit and the one or more sensors coupled to the tank, the controller configured to:

receive a signal indicative of a volume of the fluid within the tank from the fluid level sensor;

determine an estimated pressure of the fluid within the tank based on the signal indicative of the volume of the fluid within the tank received from the fluid level sensor and a breather performance curve associated with the breather valve;

receive a signal indicative of a pressure of the fluid within the tank from the pressure sensor;

compare the estimated pressure with the pressure of the fluid within the tank;

determine the health status of the tank based, at least in part, on the comparison; and actuate one or more of the operator console display unit and the at least one hydraulic actuator based upon the determined health status of the tank.

9. The system of claim 8, wherein the determination of the health status further includes:

determining if a difference between the estimated pressure and the pressure of the fluid exceeds a first threshold; and determining the health status of the tank based, at least in part, on the difference exceeding the first threshold.

10. The system of claim 9, wherein the determination of the health status further includes:

determining a number of instances the difference between the estimated pressure and the pressure of the fluid exceeds the first threshold within a predetermined amount of time; and determining the health status of the tank based, at least in part, on the number of instances exceeding a second threshold.

11. The system of claim 8, wherein the determination of the health status further includes:

determining if a rate of change of the pressure of the fluid with respect to the estimated pressure within a predetermined amount of time exceeds a third threshold; and determining the health status of the tank based, at least in part, on the rate of change of the pressure of the fluid exceeding the third threshold.

12. The system of claim 8, wherein the controller is further configured to:

monitor the pressure of the fluid within the tank;

compare the pressure of the fluid with a pressure threshold range;

determine the health status of the tank based, at least in part, on the comparison; and indicate the health status of the tank through the operator console.

13. The system of claim 8, wherein the breather performance curve includes an air flow rate through the breather valve based on the pressure of the fluid within the tank.

14. A method for determining a health status of a tank, the method comprising:

receiving a signal indicative of a temperature of a fluid within the tank from a temperature sensor;

receiving a signal indicative of a volume of the fluid within the tank from at least one sensor coupled to at least one hydraulic actuator;

determine an estimated pressure of the fluid within the tank based on the signal indicative of a temperature of the fluid within the tank received from the temperature sensor and the signal indicative of the volume of the fluid within the tank received from the at least one sensor coupled to the at least one hydraulic actuator and a breather performance curve associated with a breather valve;

receiving a signal indicative of a pressure of the fluid within the tank from a pressure sensor;

comparing the estimated pressure with the pressure of the fluid within the tank;

determining the health status of the tank based on the comparison; and actuating one or more of an operator console display unit and the at least one hydraulic actuator based upon the determined health status of the tank.

15. The method of claim 14 further includes:

receiving a signal indicative of a fluid level within the tank from a fluid level sensor;

determining an estimated pressure of the fluid within the tank based on the signal indicative of the fluid level and the breather performance curve;

comparing the estimated pressure with the pressure of the fluid within the tank;

determining the health status of the tank based, at least in part, on the comparison; and indicating the health status of the tank.

16. The method of claim 15, wherein the determination of the health status further includes:

determining if a difference between the estimated pressure and the pressure of the fluid exceeds a first threshold; and determining the health status of the tank based, at least in part, on the difference exceeding the first threshold.

17. The method of claim 16, wherein the determination of the health status further includes:

determining a number of instances the difference between the estimated pressure and the pressure of the fluid exceeds the first threshold within a predetermined amount of time; and determining the health status of the tank based, at least in part, on the number of instances exceeding a second threshold.

18. The method of claim 15, wherein the determination of the health status further includes:

determining if a rate of change of the pressure of the fluid with respect to the estimated pressure within a predetermined amount of time exceeds a third threshold; and determining the health status of the tank based, at least in part, on the rate of change of the pressure of the fluid exceeding the third threshold.

19. The method of claim 15 further includes:

monitoring the pressure of the fluid;

comparing the pressure of the fluid with a pressure threshold range;

determine the health status of the tank based, at least in part, on the comparison; and indicating the health status of the tank.

20. The method of claim 15, wherein the breather performance curve includes an air flow rate through the breather valve based on the pressure of the fluid within the tank.

* * * * *